US005197637A

United States Patent [19]

Naumann

[11] Patent Number: 5,197,637

[45] Date of Patent: Mar. 30, 1993

[54] PUMP APPARATUS FOR A FREE-FLOWING, IN PARTICULAR PASTY AND/OR LIQUID, PRODUCT, AND DISPENSER HAVING SUCH A PUMP APPARATUS

[75] Inventor: Wilhelm K. Naumann, Gaggenau, Fed. Rep. of Germany

[73] Assignee: Compagnie Francaise des Matières Plastiques PLASCO, Huningue, France

[21] Appl. No.: 680,749

[22] Filed: Apr. 5, 1991

[30] Foreign Application Priority Data

Apr. 9, 1990 [CH] Switzerland ..... 1200/90

[51] Int. Cl.[5] ..... B65D 37/00

[52] U.S. Cl. ..... 222/207; 222/260; 222/494

[58] Field of Search ..... 222/207, 209, 213, 494, 222/464, 386, 260, 262

[56] References Cited

U.S. PATENT DOCUMENTS

| | | | |
|---|---|---|---|
| 4,519,530 | 5/1985 | Schmidt | 222/494 |
| 4,913,322 | 4/1990 | Stoffler et al. | 222/207 |
| 4,930,667 | 6/1990 | Holzner, Sr. | 222/494 X |
| 4,946,076 | 8/1990 | Hackmann et al. | 222/260 X |
| 4,978,036 | 12/1990 | Burd | 222/494 X |

FOREIGN PATENT DOCUMENTS

| | | |
|---|---|---|
| 0321279 | 6/1989 | European Pat. Off. . |
| 0363307 | 4/1990 | European Pat. Off. . |
| 8518670 | 9/1985 | Fed. Rep. of Germany . |
| 2340074 | 9/1977 | France . |

*Primary Examiner*—Gregory L. Huson
*Attorney, Agent, or Firm*—Spencer, Frank & Schneider

[57] ABSTRACT

A pump for a free-flowing, in particular pasty or liquid, substance includes a support part, a pump element which has an elastically deformable membrane and can be pressed against the support part in opposition to a restoring force, and a pump chamber, disposed between the pump element and the support part, fluidly connected to an inlet valve and to an outlet aperture by an outlet valve, the outlet aperture passing through the membrane. On a side of the membrance which faces the pump chamber, a disk is provided, the disk together with the membrane forming the outlet valve, the disk being connected to the membrane so that in a closed position the membrane rests against the disk in an area enclosing the outlet aperture, and so that in an open position the membrane is arched upward partly away from the disk by a pressure exerted on it by the free-flowing substance, thereby forming an open connection between the outlet aperture and the pump chamber. The membrane is firmly connected to the disk in a connecting sector enclosing the outlet aperture of the membrane, at least around the major part of its circumference. The disk has at least one passage which connects the pump chamber to a surface area of the disk, which surface area is at least partially enclosed by the connecting sector and faces the membrane. The aperture of the at least one passage which terminates at the surface area of the disk is located a distance away from the outlet aperture in a plan view of the membrane.

20 Claims, 9 Drawing Sheets

PUMP APPARATUS FOR A FREE-FLOWING, IN PARTICULAR PASTY AND/OR LIQUID, PRODUCT, AND DISPENSER HAVING SUCH A PUMP APPARATUS

BACKGROUND OF THE INVENTION

1. Field of the Invention

The invention relates to a pump apparatus for a free-flowing, in particular pasty and/or liquid, product and a dispenser having such a pump apparatus. The pump apparatus and the dispenser are intended in particular for pumping or storing and dispensing a product for personal hygiene and/or cleaning, for example for skin care. The product may be, for example, pasty and consist of a paste or cream. The product can, however, also consist of a liquid, for example a liquid sunscreen agent or a liquid soap, all intermediate states between pasty and liquid being possible.

Many free-flowing cosmetic products intended for personal hygiene, in particular skin care, tend to undergo undesired changes under the action of air and/or light. For example, such products may contain active ingredients and/or auxiliaries and/or fragrance materials, such as, for example, sunscreen substances or essential oils, which may oxidize under the action of the oxygen present in the air and/or, under the action of water vapor present in the atmosphere, may react with the latter and/or with one another, and/or may react chemically in another manner. There is also the danger that certain components present in the products, such as water, alcohol and other readily volatile substances, escape in the air by vaporization and/or evaporation from the products. It is known that preservatives and the like can be added to the products to inhibit undesired chemical changes of the stated type and possibly also to inhibit drying out. However, this is only partially successful. Moreover, preservatives may reduce the effectiveness of the active ingredients and/or have other undesired side effects.

It would therefore be advantageous in case of many products intended for skin care if they were stored in such a way that they do not come into contact with the air directly until they are used, i.e. during application to the skin. In the case of certain products containing a plurality of different active ingredients and auxiliaries, it would furthermore be advantageous, for avoiding undesired chemical reactions or other changes, to store two or more components of the relevant product separately and not mix the components until immediately before use, in the prescribed ratio.

2. Description of the prior art

There are already various dispensers for a pasty product, in particular toothpaste, having a store and a pump apparatus for pumping out the product. German Utility Model 8 518 670 discloses, for example a dispenser for dispensing a toothpaste having two components, i.e. having a main component and having an additional substance serving for the formation of colored stripes. The dispenser has a tubular container having an intermediate ceiling and a casing in which a piston is displaceable. The latter forms the lower limit of a main store containing the main component of the toothpaste. The container also serves as a support for the pump apparatus which has, above the intermediate ceiling, a pump element which is connected to said ceiling, is dome-shaped, consists of an elastically deformable membrane, is provided with a thick part providing rigidity in the central area of the dome and, together with the intermediate ceiling, defines a pump chamber. The intermediate ceiling is provided with an inlet valve which connects the main store to the pump chamber and has a rotatable valve flap. The pump chamber is connected via an approximately horizontal passage and an outlet valve, which has a rotatable valve flap, to an outlet which is arranged adjacent to the pump element at an edge position of the intermediate ceiling, is formed by a nozzle and has an approximately rectangular cross-section. Two stores, arc-shaped in outline, for the additional substance are present on both sides of the nozzle serving as an outlet. These two stores for additional substance are each connected, via an orifice present in the side walls of the outlet connection, to the outlet aperture defining the outlet connection. Each of the two stores for additional substance is limited at the bottom by an elastically deformable base which is provided with two non-return valves, each having a flap. One of these two non-return valves permits the passage of paste from the pump chamber into the relevant store for additional substance. The other non-return valve present in the base of each of the two stores for additional substance connects the relevant store for additional substance to the main store.

When the dispenser disclosed in German Utility Model 8 518 670 is filled, the additional substance is first introduced into the two stores for additional substance by means of a press, through the main store and the non-return valves connecting said store to the store for additional substance. The paste serving as the main component is then introduced into the main store from below, and the latter is closed with the piston. If a person uses the dispenser, he or she presses the dome-shaped pump element against the intermediate ceiling of the container, in opposition to the recovery force generated by the resilience of said pump element. When the pump element is pressed down, paste present in the pump chamber is pressed into the outlet and through the latter to the outside. At the same time, the non-return valves connecting the pump chamber to the stores for additional substance are also opened, so that paste is also forced from the pump chamber into the stores for additional substance. This paste in turn then forces additional substance stored in the latter into the outlet. If the person using the dispenser releases the pump element, the pump element arches upward owing to its resilience, paste being sucked from the main store into the pump chamber.

The dispenser disclosed in German Utility Model 8 518 670 has various disadvantages and would in particular be disadvantageous for dispensing a product intended for skin care. The outlet consisting of a nozzle in fact contains, after the dispenser has been used for the first time, a relatively large amount of the pasty product, which is exposed to the effect of air until the dispenser is next used. As already explained further above, contact with air may, however, have a very adverse effect on the products intended for skin care and furthermore may in certain circumstances cause blockage of the outlet as a result of the product drying out. Furthermore, the users of pasty skin care products are used to removing these with a finger from a jar-like or tub-like container, and pressing the product out of a nozzle is therefore undesirable and disadvantageous. Since, in the known dispenser, the pump chamber bordered at the top by the dome-shaped pump element, the passage connecting said chamber to the outlet, the outlet aperture defined by a nozzle and the stores for additional substance have relatively large volume, a relatively large amount of the product remains therein after the dispenser has been used for the last time, which is likewise disadvantageous in view of the high price of various skin care products. Since some of the paste pressed out of the pump chamber and serving as the main component of the product enters the stores for additional substance when the dispenser is operated, the components may mix in these stores which is also disadvantageous. The additional substance pressed out of the stores for additional substance into the outlet therefore presumably also contains, after the dispenser has been used a few times, some of the paste forming the main component. The mixing ratio of the two components may therefore change in an undesirable manner in the course of the period of use of the dispenser. Because the product components pumped out of the various stores follow a complicated path running around various corners, and because the piston is arranged below the paste present in the main store and must be pushed upward on emptying the main store, against its own weight and especially the weight of the paste present above it, a great deal of force is furthermore required for pumping out the product. In addition, the known dispenser is complicated and accordingly expensive.

A European Patent Application (Publication No. 0 363 307) of the applicant, published on Apr. 11, 1990, proposed dispensers with pump apparatuses in which the pump element defining the pump chamber on one side consists essentially completely of a membrane which is provided with an outlet aperture, and together with a rigid pin fastened to the wall part, forms the outlet valve. In the rest state, the membrane lies on the end face of the pin, part of said membrane surrounding the outlet aperture. If a person presses on the membrane with a finger, the product present in the pump chamber can cause the membrane to arch upward in the region of the pin, so that the outlet valve is opened and product can flow out through the outlet valve. In this dispenser, however, the membrane tends, when pressed, to arch upward depending on the pressure point, not only at the pin but also at other points remote from the pressure point, so that the volume of the pump chamber may not be reduced by the intended amount in certain circumstances and accordingly it is not the intended amount of product that is pressed out of the pump chamber and afterwards sucked into the pump chamber from the store when the membrane is released.

SUMMARY OF THE INVENTION

It is an object of the invention to overcome disadvantages of the known pump apparatuses and dispensers. Starting from the prior art disclosed in German Utility Model 8 518 670, it is intended in particular to provide a pump apparatus and a dispenser which has an outlet aperture, possesses only a small volume and permits a person to spread the dispensed product with at least one finger, similarly to a jar-like container. Furthermore, the pump apparatus and the dispenser should permit the dispensing of as large a part as possible of the product and should be capable of being produced in an economical manner.

This object is achieved by a pump apparatus for a free-flowing, in particular pasty or liquid, product, having a support part, a pump element which has an elastically deformable membrane and can be pressed against the support part in opposition to a restoring force, and a pump chamber which is present between said pump element and the support part and is connected to an inlet valve and, via an outlet valve, to an outlet aperture, wherein the outlet aperture passes through the membrane and wherein, on that side of said membrane which faces the pump chamber, a disk, which together with the membrane forms the outlet valve, is arranged and is connected to the membrane in such a way that the latter, in a closed position, rests against the disk in an area enclosing its outlet aperture and, in an open position, is arched upward partly away from the disk by a pressure exerted on it by the product and can open a connection between its outlet aperture and the pump chamber. It is a further object of the invention to provide a dispenser having a pump apparatus for a free-flowing, in particular pasty or liquid, product, having a support part, a pump element which has an elastically deformable membrane and can be pressed against the support part in opposition to a restoring force, and a pump chamber which is present between said pump element and the support part and is connected to an inlet valve and, via an outlet valve, to an outlet aperture, wherein the outlet aperture passes through the membrane and wherein, on that side of said membrane which faces the pump chamber, a disk, which together with the membrane forms the outlet valve, is arranged and is connected to the membrane in such a way that the latter, in a closed position, rests against the disk in an area enclosing its outlet aperture and, in an open position, is arched upward partly away from the disk by a pressure exerted on it by the product and can open a connection between its outlet aperture and the pump chamber.

The pump apparatus can, for example, have only a single pump chamber. However, the pump apparatus can also have two or possibly even more pump chambers arranged side by side, each of which is connected via an outlet valve to a coordinated store of the dispenser for separate storage of different components of the product to be dispensed. When the pump element of the pump apparatus is operated, these various components can be fed in a predetermined mixing ratio to the common outlet aperture and can be mixed with one another before and/or in said outlet aperture.

The disk connected to the membrane and forming the outlet valve together with it covers, in a plan view of the membrane, preferably at least the major part, i.e. at least 50%, and better still at least 60% or even at least 80% of the surface of the or each pump chamber. The pump chamber and the disk can have, for example, a circular contour. The diameter of the disk can then preferably be at least 80% and, for example, even at least or about 90% of the internal diameter of the pump chamber.

If necessary, at least one other disk may be connected to the membrane, in addition to the disk which together with the membrane forms the outlet valve. The disk which serves for forming the outlet valve can then be arranged, for example, eccentrically with respect to the center of the membrane, in an incision or in an orifice of the other, larger side. In this case, the above-mentioned conditions for the surface covered by the disk and the diameter of the disk can then be fulfilled by the totality of the disks connected to the membrane.

The or each disk connected to the membrane is preferably in general dimensionally stable and is more rigid than the membrane, in particular at least in the major part of its side or surface facing the membrane, i.e. at least at 50% of its area occupied in a plan view of the membrane and thus, for example, in outline. Each disk is preferably more rigid than the membrane everywhere—with the possible exception of at least a small disk section serving as a spring or flexible joint. The disk should preferably be more rigid than the membrane, particularly in an area where said membrane rests against said disk when the outlet valve is closed and which, in a plan view of the membrane, encloses its outlet aperture and/or valve aperture.

BRIEF DESCRIPTION OF THE DRAWINGS

The subject of the invention and further advantages thereof are now illustrated by embodiments shown in the drawing. In the drawing.

DETAILED DESCRIPTION OF THE PREFERRED EMBODIMENTS

Figure 1:
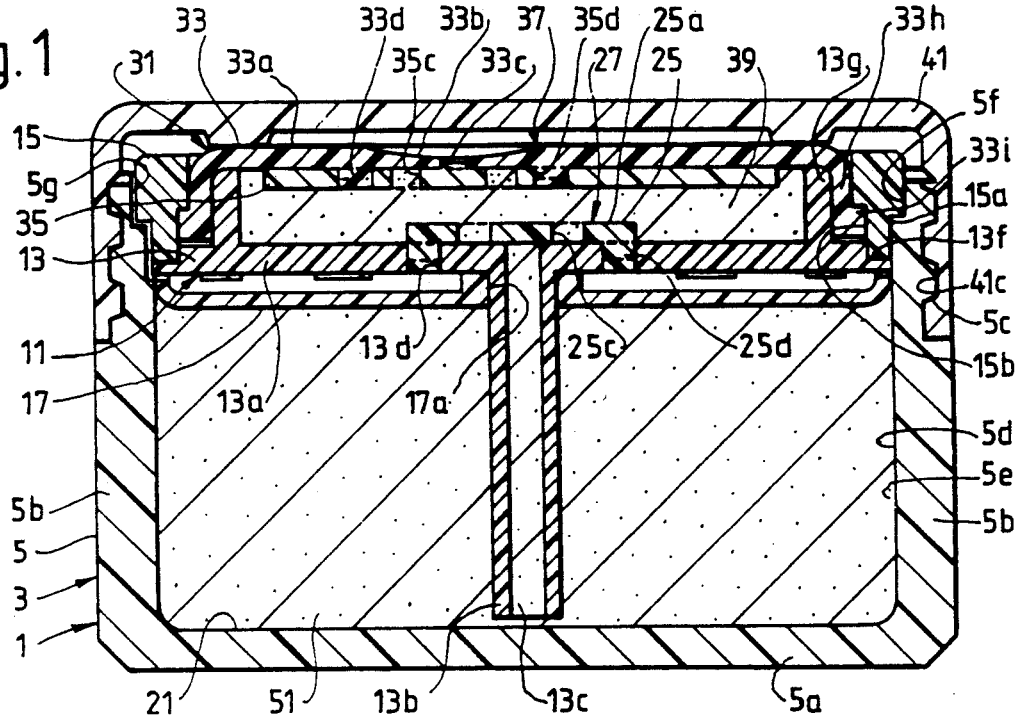
FIG. 1 shows a vertical or axial section through a dispenser having a single store and a pump element in the rest state.
Figure 2:
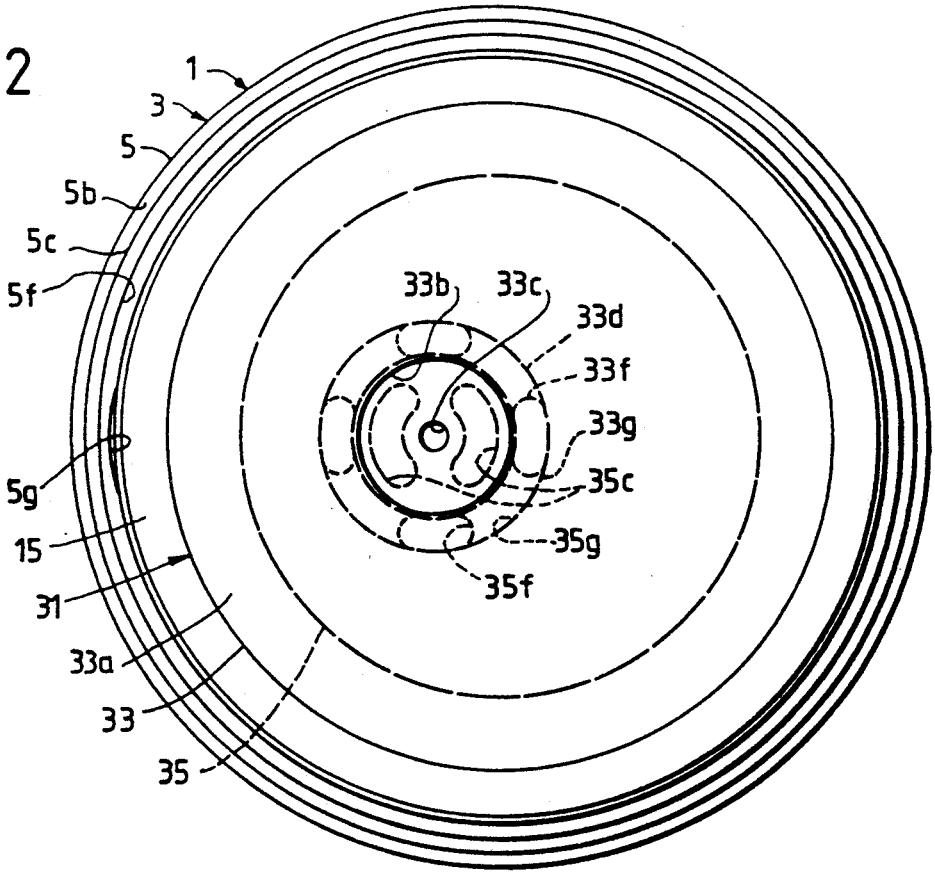
FIG. 2 shows a plan view of the pump element of the dispenser drawn in FIG. 1, with the cover removed.

The dispenser 1 shown in FIG. 1 and—apart from the cover—in FIG. 2 has a container 3 which possesses, as the main part, an integral, dimensionally stable case 5 having a flat, horizontal base 5*a* and a generally cylindrical sidewall 5*b*. The latter has, on the outside of its upper end, a slightly thinner section having an external thread 5*c* and an internal surface 5*d* on the inside. This has an essentially cylindrical main section 5*e* at the bottom and, at the upper end, likewise essentially cylindrical extension 5*f* which forms a radial shoulder surface at its base. However, the internal surface 5*d* is provided, in at least one peripheral point, with a recess 5*g* which extends from the mouth of the extension 5*f* at an angle through the shoulder surface present at its base, into the upper end region of the main section 5*e*.

A pump apparatus 11 arranged essentially at the upper end of the case 5 has a support 13 which consists of an integral, dimensionally stable element. The support 13 has a generally flat, horizontal, plate-shaped support part 13*a* which is arranged in the upper end region of the interior of the case 5, is radial with respect to the case axis and is also referred to briefly below as plate 13*a*. This forms both a wall part of the pump apparatus 11 and the entire container 3, i.e. the bottom part of the pump apparatus and an intermediate ceiling of the container 3. The plate 13*a* is associated at its center with a nozzle 13*b* projecting away from it downward to a point close to the base 5*a*. The support 13 is provided with a straight, axial passage 13*c* which is circular in cross-section, has an section formed by the interior of the nozzle and a section penetrating the plate 13*a* and extends from the lower nozzle end continuously to the upper side of the plate 13*a*. The plate 13*a* is provided, in an annular connecting section 13*d* on its lower side, with an annular groove which encloses the nozzle 13*b* in plan view and whose base is entered by a few through anchoring holes which are distributed around its circumference and consist of slots or longitudinal holes bent coaxially with respect to the annular groove. The plate 13*a* has, on its upper side, a channel 13*f* running along its edge and, slightly inside this, a hollow cylindrical, annular collar 13*g* which projects axially upward and whose edge is rounded on the outside.

A dimensionally stable retaining ring 15 is bordered in the upper region, outside and inside, by a cylindrical surface and has, in its lower region, a channel 15*a* on the outside and an extension 15*b* on the inside. The upper, thicker end section of the retaining ring 15 is for the most part located in the extension 5*f* and rests, with the shoulder surface formed by its channel 15*a*, on the shoulder surface formed by the extension 5*f* of the case 5. The lower, thinner end section of the retaining ring 15 projects into the channels 13*f* of the plate 13*a*. The plate 13*a* is connected rigidly and tightly, for example by ultrasonic welding, to the retaining ring 15, which in turn is connected rigidly and tightly, for example by ultrasonic welding, to the sidewall 5b of the case 5. The support 13 and the retaining ring 15 together form the fixed wall of the pump apparatus 11 and, together 15 with the case 5, form the fixed wall of the container 3.

An axially displaceable, integral piston 17, which has a disk with a central aperture 17a penetrated by the nozzle 13b, is arranged inside the container 3, between the base 5a and the plate 13a. At the latter and at the outer edge, the disk has in each case an upward-projecting, coaxial collar for guided displacement and sealing of the piston. The collar located at the outer edge is provided, at its upper end, with a few incisions distributed over its circumference and serving as air channels. In its starting position shown in FIG. 1, the piston can rest on the plate 13a with both collars. In the starting position, a narrow space is present between that part of the piston which is located between the two collars and the plate 13a, said space being connected, when the container 3 is opened, through the incisions in the outer collar and the recess 5g to that region of the surrounding space which is located above the edge of the sidewall 5b and of the retaining ring 15. That region of the container interior which is present between the base 5a and the piston 17 forms a storage chamber or—in brief—a store 21.

An integral, soft, resilient element 25 has, as a main component, a flat membrane 25a which is disk-shaped in the undeformed rest state, lies on the upper side of the plate 13a and has at least one valve aperture and preferably a plurality of valve apertures 25c, preferably two valve apertures 25c. These are distributed, in the plan view, around the mouth of the passage 13c of the plate 13a and consist of slots or longitudinal holes bent coaxially with respect to the passage 13c. In the plan view, the valve apertures 25c are arranged between the passage 13c and the annular connecting sector 13d enclosing said apertures, in such a way that each valve aperture 25c is a distance away from the passage 13c and preferably also from each anchoring hole present in the connecting sector 13d. The membrane 25a is firmly and tightly connected to the plate 13a by connecting means 25d in the connecting sector 13d of the plate 13a. The connecting means 25d have, at each anchoring hole, a peg which passes with a tight fit through said anchoring hole and is associated with the membrane 25a. The pegs are connected to one another by an annular retaining section which is associated with said pegs, is located in the annular groove of the connecting sector of the plate 13a, rests on the base of the annular groove and fills the latter. The membrane 25a is associated, at its outer edge, with a collar 25f which projects axially away from the plate 13a in an upward direction as far as the edge of the collar 13g. The collar 25f rests with its outer surface on the inner surface of the collar 13g. The edge of the collar 25f is rounded inward and downward, away from the inner edge of the border of the collar 13g. The central areas of the plate 13a and of the membrane 25a together form an inlet valve 27 of the pump apparatus 11.

Figure 3:
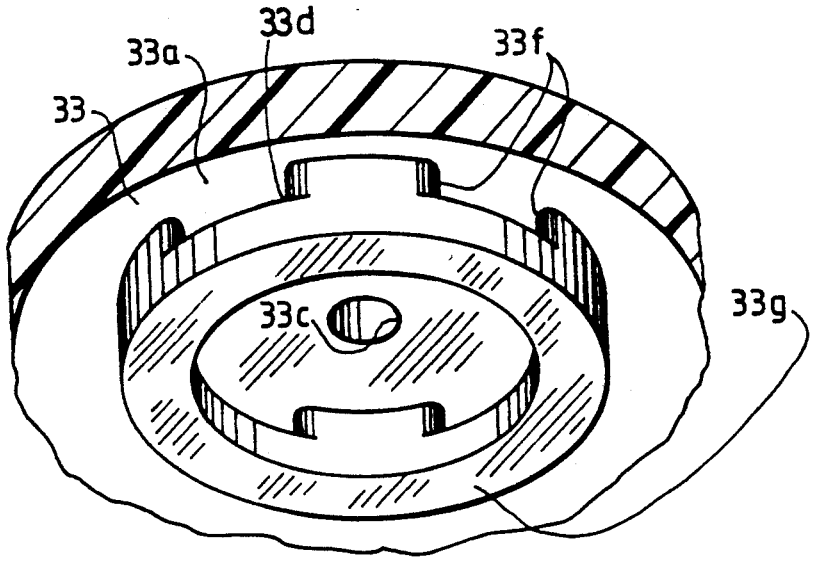
FIG. 3 shows an oblique view from below of a section of the membrane belonging to the pump element, where the disk of the pump element is in principle non-detachably connected to the membrane and has been omitted.
Figure 4:
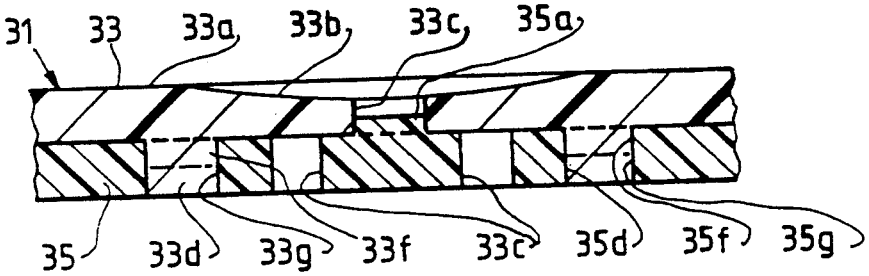
FIG. 4 shows a view from FIG. 1 containing a part of the pump element with the outlet valve closed, on an enlarged scale.

The pump apparatus 11 also includes a pump element 31 which is arranged above the plate 13a and thus on its side facing away from the store 21 and which has an integral, relatively soft, resilient element 33 and an integral disk 35. The element 33 has a membrane 33a with a horizontal, disk-shaped and circular main part which is flat in the undeformed rest state. This main part is provided on its upper side with a dish-shaped, relatively flat recess 33b, whose deepest point is joined to a through outlet and/or valve aperture 33c. The limiting surface of the recess 33b extends, without edges, from the mouth of the outlet and/or valve aperture 33c to its outer edge and has, for example, a continuous concave curve but may also be conical. The recess 33b and the aperture 33c are, for example, arranged eccentrically with respect to the membrane 33a and to the sidewall 5b in the case 5 and thus have an axis displaced from the case axis but parallel thereto. The element 33 has connecting means 33d having a plurality of, for example four, pegs 33f associated with the membrane 33a and distributed uniformly on a circle concentric with respect to the aperture 33c. These are bent according to FIGS. 2 and 3 along the said circle and are associated, at their end facing away from the membrane 33a, with an annular retaining section 33g shown particularly clearly in FIG. 3. It should be noted here that the membrane 33 in FIG. 3 has been drawn separate from the disk 35 for greater clarity, but in reality cannot be separated from the disk 35 without destruction. The membrane 33a rests with its outer edge or—precisely with the outer edge of its arc-shaped main part which is flat in the rest state—on the edge of the collar 13g and is associated there, via a continuously bent transition section, with a generally cylindrical edge section 33h projecting downward, i.e. toward the store 21. This edge section projects from above flush into the annular gap present between the collar 13g and the retaining ring 15 and is provided at its lower end with a projection 33i which projects outward and engages the extension 15b of the ring 15. The membrane 33a is thus connected, by means of its edge section 33h, at the upper edge of the sidewall 5b of the case 5, firmly with the latter and with the plate 13a and hence with the fixed wall of the container 3.

The disk 35 is arranged on the lower side of the main part of the membrane 33a, said side facing the store 21 and said main part being flat in the rest state. The disk 35 is generally flat but has an upward-projecting cam 35a and is provided with at least one passage 35c and preferably with a plurality of these, for example two of these, which, in plan view, are offset from the outlet and/or valve aperture 33c present in the membrane 33a and are distributed around said aperture and are thus a distance away from it. Passages 35c can consist of slots or longitudinal holes and, in the plan view, form arcs coaxial with the axis of the outlet and/or valve aperture 33c. The disk 35 is tightly and firmly connected to the membrane 33a by the connecting means 33d in an inner, annular connecting sector 35d which, in the plan view, encloses the passages 35c at a distance. In the connecting sector 35d, the disk 35 has, for each peg 33f, a through anchoring hole 35f which is penetrated by said peg and has the same contour as said peg. The anchoring holes 35f end in a circular retaining groove 35g which is present on the underneath of the disk 35 and contains the annular retaining section 33g of the connecting means 33d, which section rests on the base of said groove and fills said groove. Those areas of the membrane 33a and of the disk 35 which are provided with the hole 33c and the passages 35c together form the outlet valve 37 of the pump apparatus 11.

It should be noted here that the anchoring holes of the plate 13a, which were described further above and, for greater clarity, are not drawn in FIG. 2, and the pegs of the connecting means 33d, which are associated with the membrane 25a, may have contours and dimensions which are identical or similar to those of the anchoring holes 35*f* of the disk 35 or of the pegs 33*f* associated with the membrane 33*a*.

A free space, which serves as pump chamber 39 is present between the membrane 25*a* forming part of the inlet valve 27 and the disk 35 forming part of the outlet valve 37.

The dispenser 1 also has a cover 41 having an internal thread 41*c* which can be screwed with the external thread 5*c* of the case 5. In the screwed-on state, the cover 41 closes the case 5 and hence the entire container 3 with a seal which is almost gas-tight.

Apart from the pasty product 51 to be stored, the various parts of the dispenser all consist, for example, of a thermoplastic which can be injection molded. The parts which serve for forming the fixed wall of the container 3—i.e. the case 5, the support 13 and the retaining ring 15—and also the disk 35 and the cover 41 consist of more or less hard and dimensionally stable thermoplastic. These parts and in particular the support 13 and the disk 35 may have a modulus of elasticity of at least 1000 MPa and, for example, at least 2000 MPa and may contain polypropylene or polystyrene or a copolymer of one of these plastics, such as, for example, polystyrene/acrylonitrile, for example as a basic and main component. The two elements 25, 33 which form the membranes 25*a* and 33*a*, respectively, consist of a softer material having a lower modulus of elasticity, for example one which is not more than 500 MPa and preferably not more than 400 MPa or even not more than 100 MPa. The elements 25, 33 are thus relatively flexible and resilient or even elastomeric and may consist, for example, of a polyethylene, polyamide or a blend containing at least one additive, or of silicone rubber. It should be noted in particular that the whole of the side or surface of the disk 35 which faces the membrane is more rigid than the membrane 33*a* and thus dimensionally stable, at least in comparison with said membrane. The piston 17 consists of a plastic whose modulus of elasticity is approximately between that of the parts forming the wall of the container and that of the membranes 25*a*, 33*a* and is, for example, about 600 to 1000 MPa.

The parts of the dispenser 1 are preferably all produced by injection molding. For the production of the two valves 27, 37, the essentially dimensionally stable element 13 and the essentially dimensionally stable disk 35 are first molded. The flexible, resilient elements 25 and 33 forming the membranes 25*a*, 33*a* are then molded onto the support 13 or onto the disk 35, respectively. In these injection molding processes, the free-flowing molding material penetrates the anchoring holes and thus forms the connecting means 25*d* and 33*d*. The pump element 31 consisting of the element 33 and of the disk 35 can then be clamped firmly with the aid of the retaining ring 15 on the support 13 forming the plate 13*a*, and the retaining ring 15 can be connected firmly to the plate 13*a*, for example by ultrasonic welding. To fill and complete the dispenser 1, the pasty product 51 is filled into the case 5 from above. The piston 17 is then pushed onto the nozzle 13*b* until it rests against the plate 13*a*, and is placed, together with the pump apparatus 11, in the case 5. During and/or after insertion of the pump apparatus, pasty product also flows into the passage 13*c* of the inlet valve 27, through the latter and into the pump chamber 39 and preferably also into the passages 35*c* forming part of the outlet valve 37. The retaining ring 15 is then connected to the sidewall 5*b* of the case 5, for example by ultrasonic welding. Advantageously, a tear-off cover foil which is not shown, covers at least the outlet and/or valve aperture 33*c* of the membrane 33*a* and, for example the entire membrane 33*a*, the retaining ring 15 and the edge of the case sidewall 5*a* and provides an almost or completely gas-tight seal against the environment is also adhesively bonded, or fastened in another way, to the membrane 33*a* and/or to the retaining ring 15 and/or to the edge of the case sidewall 5*a*. Finally, the cover 41 is also screwed on.

When the pump apparatus 11 is in the rest state shown in FIG. 1, the disk 35 is parallel to the plate 13*a* and—when the dispenser is upright—is horizontal like said plate. The membrane 25*a* then lies tightly against the plate 13*a* as far as the collar 13*g* and thus in particular in that area of the plate 13*a* which is enclosed by the connecting sector 13*d*, so that the inlet valve 27 is closed. The membrane 23*a* rests tightly against that surface of the disk 35 which faces it and in particular against its surface area enclosed by the connecting sector 35*d*. Furthermore, the cam 35*a* projects flush or at most with a small, radial play into the outlet and/or valve aperture 33*c*, so that the outlet valve 37 is closed.

Figure 5:
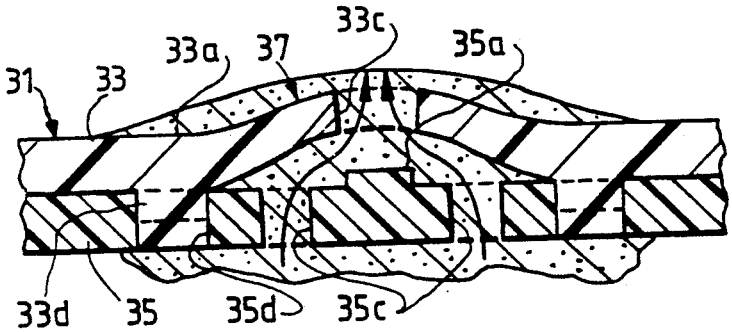
FIG. 5 shows a section corresponding to FIG. 4 but with the outlet valve open.

The membrane 33*a* can be elastically deformed, i.e. bent and stretched, in an annular deformation area located between the outer limit of the connecting means 33*d* and the cylindrical edge section 33*h*. If a person wishes to withdraw pasty product from the dispenser, he or she first removes the cover 41, tears off the cover foil covering the membrane 33*a* of the dispenser until the latter is used for the first time, and then presses manually around and from above, i.e. with at least one finger, at a pressure point of the membrane 33*a* which is located, in the plan view, in the region of a disk 35 and adjacent to the outlet and/or valve aperture 33*c*—approximately in the centre of said membrane—on said membrane. The inner part of the pump element 31, which part in the plan view is located inside the collar 25*f*, and in particular the disk 35, starting from its rest position shown in FIG. 1, can thus be pushed in opposition to the restoring force generated by the elasticity of the membrane 33*a*, against the plate 13*a*, so that the volume of the pump chamber 39 is reduced. If the person using the dispenser releases the pump element, the said restoring force causes the inner part of the membrane 33*a* and the disk 35 to return to the rest position, so that the pump element is in the rest state again. When the inner part of the pump element is depressed, the pasty product present in the pump chamber is subjected to a pressure which opens the outlet valve 37. That area of the membrane 33*a* which is enclosed in the plan view by the connecting means 33*d* is elastically deformed and is caused to arch upward by the pasty product in the manner shown schematically in FIG. 5, so that the cam 35*a* projects from the outlet and/or valve aperture 33*c* and the connecting passage is opened up between this and the passages 35*c*. As a result of the pressure generated, a portion of pasty product 51 then flows from the pump chamber 39 through the passages 35*c* of the disk 35, through the said connecting passage and the outlet and/or valve aperture 35*c* of the membrane 33*a* onto the upper, outer side of the surface of the latter and into the recess 33*b* and eventually onto that part of the membrane 33*a* which is adjacent to said recess. This outflow of pasty product is indicated by arrows in FIG. 5. At the end of the outflow process, the elasticity of the membrane 33*a* causes it to return to its rest shape assumed in the rest state, with the result that the outlet valve is closed again. The person using the dispenser 1 can scrape off, with at least one finger, the portion of the product present on the sides of the membrane 33a. At least when the dispenser is no longer to be used for a prolonged period, it is advantageous if the cover 41 is screwed on to the case 5 again after removal of pasty product.

If the inner part of the membrane 33a and the disk 35 of the pump element 31 move back therefrom to the rest position after temporary depression, the inlet valve 27 is opened as a result of the negative pressure generated in the pump chamber 39, and pasty product is sucked out of the store 31 in the pump chamber 39. The opening process of the inlet valve is similar to that described for the outlet valve. The piston 17 slides downward as a result of the negative pressure generated in the store 21 during the sucking out procedure and under its own weight, and thus follows the product level. Air from the environment can flow in through the one or more recesses 5g and the incisions in the upward-projecting, outer collar of the piston 17 and into the intermediate space between the plate 13a and the piston 17, which intermediate space becomes larger and/or is newly formed as the piston slides downward.

Following the above description of the form and the general function of the dispenser, it is now intended to explain some details and advantages.

The portion of pasty product pressed out of the dispenser 1 when the pump element 31 is operated, can be removed directly from the membrane 33a in such a way that, even with long fingernails, no product enters under the fingernail of the person using the dispenser. The base area of the recess 33b, which area is relatively flat in the axial section and is continuously curved, also enables product present in the recess 33b to be removed easily and virtually completely when the dispenser is used.

According to FIG. 1, the diameter of the disk 35 is only slightly smaller than the diameter of the main part of the pump chamber 39, or—more exactly— than the internal diameter of the lower main part of the collar 25f. The disk 35 thus covers, in plan view, the major part, i.e. about or at least 80% of the area of the pump chamber in plan view and therefore virtually the entire pump chamber. Since the disk 35 is furthermore essentially dimensionally stable, when depressed it approaches the plate 13a over the whole area which it occupies in plan view, virtually regardless of the pressure point at which a person presses with a finger on the pump element, and causes the volume of the pump chamber to decrease. The membrane 33 connected in the connecting sector 35d firmly into the disk 35 furthermore rests, when the pump element is depressed, against a large part of the surface of the disk 35 which faces it. At least when the person using the dispenser 1 presses in the central area of the pump element 31 in plan view, on the membrane 33a of the latter, the disk 35 also remains at least approximately parallel to the plate 13a on depression.

The piston 17 and the two valves 27, 37 ensure that no air or at least virtually no air from the environment can flow into the store 21. Furthermore, the outlet valve 37 also virtually completely prevents air from flowing into the pump chamber 39. Between successive removals of pasty product, only any amount of product still present above the end face of the cam 35a in the outlet and/or valve aperture 33c can thus come into contact with the surrounding air. The diameter of the aperture 33c is, however, not more than 6%, preferably not more than about 4%, of the diameter of the store 21, i.e. of the internal diameter of the case. The maximum thickness of the membrane 33a, measured axially, is likewise not more than about 6% and, for example, not more than about 4% of the store diameter. Where the external diameter of the case 5 is, for example, about 70 mm to 80 mm and the diameter of the store is about 6 mm to 10 mm smaller, the diameter of the outlet and/or valve aperture 33c can be, for example, not more than 5 mm or even only about 2 mm. Furthermore, the maximum thickness of the membrane 33a may be, for example, not more than or about 2 mm. Because of the recess 33b, the axial dimension of the aperture 33c is furthermore smaller than the maximum thickness of the membrane 33. In addition, the aperture 33c is at least partly filled by the cam 35a when the outlet valve 37 is closed. Any amount of pasty product remaining in the aperture 33c between successive product removals is therefore very small. Hence, virtually no product present in the dispenser comes into contact with the surrounding air. Accordingly, it is scarcely possible for active ingredients or other constituents of the product to react with the atmospheric oxygen and/or with the water vapor present in the air and/or, under the action of air constituents, with one another. This makes it possible to use products which contain only small amounts of preservatives or none at all. Furthermore, virtually no parts of the product can dry out. Accordingly, there is also no danger of the outlet and/or valve aperture becoming blocked.

The passages between the store 21 and the pump chamber 39 and between these and the outer mouths of the outlet and/or valve aperture 33c contain only a few corners and require only a few changes of flow direction when the product is being pumped out. This has an advantageous effect on the force and energy required for pumping out the product. This force and energy requirement is furthermore also slightly reduced by virtue of the fact that the weight of the piston 17 supports its downward movement during pumping.

When the dispenser is being used, a certain residual amount of product which cannot be pumped out may remain in the pump chamber and various valve apertures after emptying of the store 21. This residual amount is, however, relatively small compared with the total amount of product initially storeable in the dispenser.

The dispenser 1 can be prepared in an economical manner. Since the piston moves downward during product removal, the case 5 can be completely closed at the bottom. This makes it possible for cases having the same form as the case 5 also to be used for conventional dispensers not according to the invention, without a pump apparatus 11. Under certain circumstances, the cases 5 and covers 41 can thus be produced in relatively large series and therefore more economically.

Figure 6:
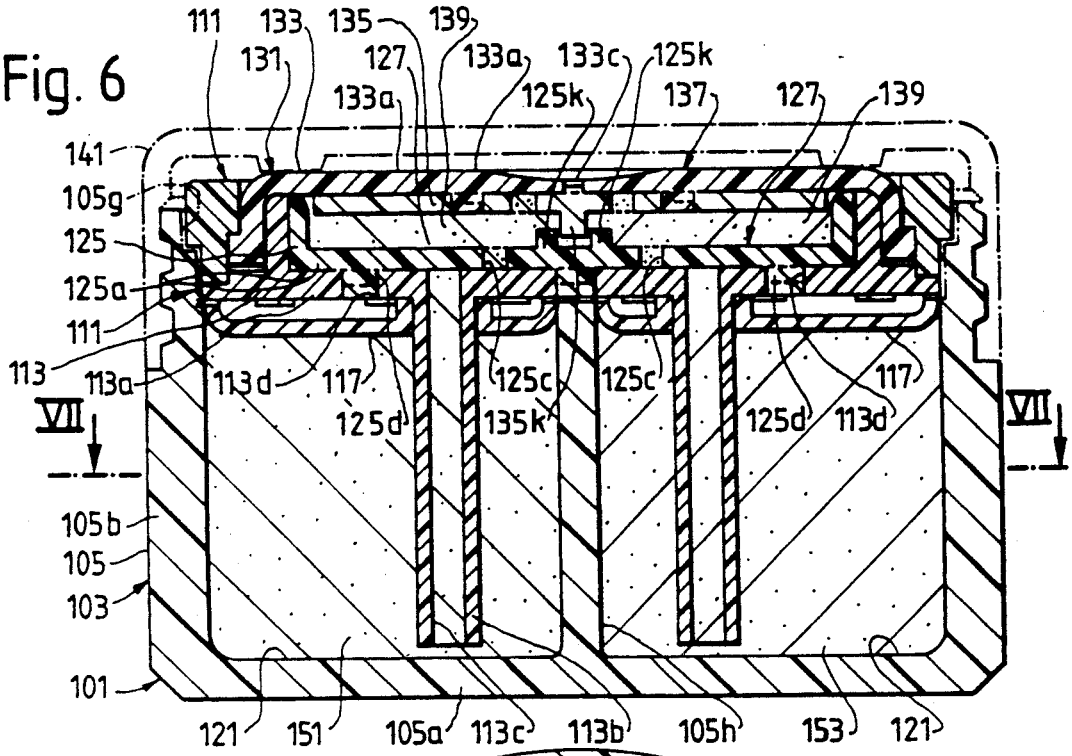
FIG. 6 shows an axial section, corresponding to FIG. 1, through a dispenser which has two stores and whose cover is indicated only in outline.
Figure 7:
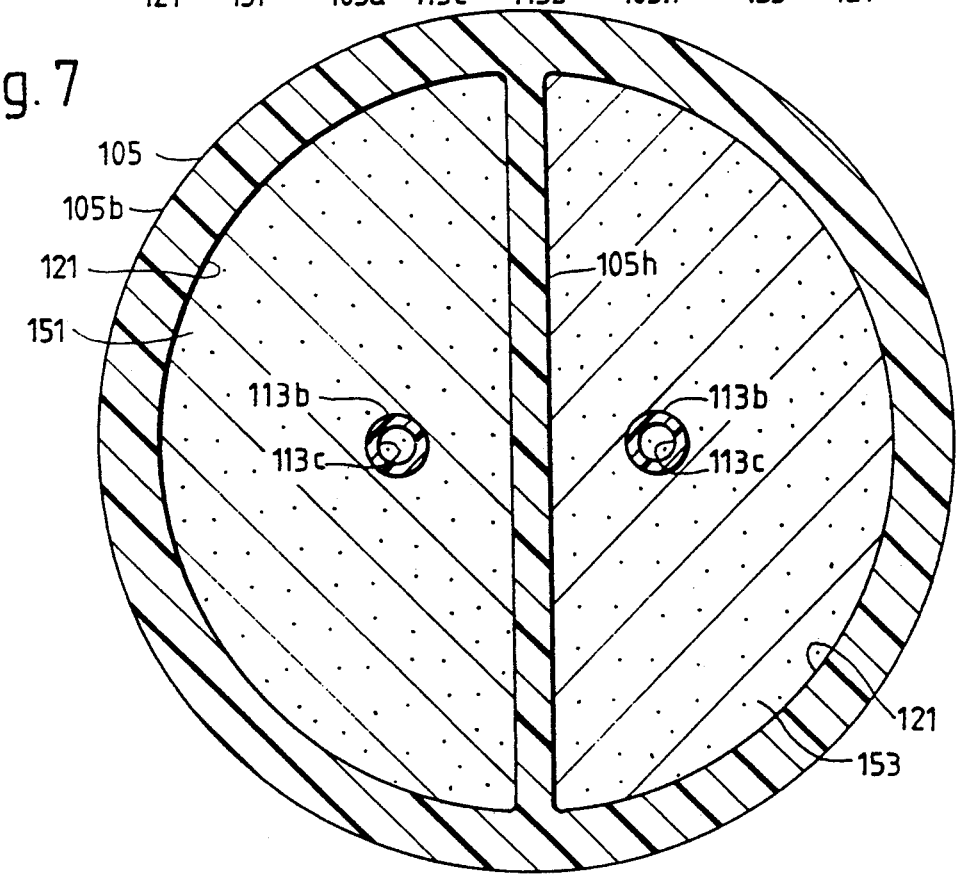
FIG. 7 shows a section through the dispenser according to FIG. 6, along a line VII—VII therein.

The dispenser 101 shown in FIGS. 6 and 7 has a container 103 having a case 105 and a pump apparatus with a dimensionally stable support 113. This consists of an integral element and possesses a flat, horizontal, plate-like support part 113a, i.e. a plate 113a. Analogously to plate 13a, this forms a wall part of the pump apparatus and of the entire container and in fact a plate of the container. The case 105 has a similar contour to the case 5 but contains a vertical partition 105a which extends from its base 105 to the underneath of the plate 113a, is associated with the base and may be arranged, for example, diametrally and may divide the interior of the case into two compartments of equal size. The side wall 105b of the case 105 is provided on the inside, in its upper edge region of each compartment, with at least one recess 105g corresponding to the recess 5g and indicated by a dash-dot line in FIG. 6. The element 113 has, for each compartment of the interior of the case, a nozzle 113b projecting into said compartment and having a passage 113c entering the upper side or surface of the plate 113a. Each of the said compartments contains a piston 117 having an aperture penetrated by the relevant nozzle, the two pistons being displaceable independently of one another. A storage chamber or—in brief—a store 121 is present between the case base 105a and each piston 117, the two stores 121 being separated from one another completely and by a tight seal.

The plate 113a is provided with a group of through anchoring holes and coherent, annular retaining grooves in two annular connecting sectors 113d which together are 8-shaped and each of which in plan view encloses an orifice of a passage 113c, which orifice has a mouth and a plate surface, said sectors, for example, overlapping one another. An element 125 which corresponds to the element 25 and has a membrane 125a which has, for each passage 113c, at least one valve aperture 125c laterally displaced with respect to said aperture is arranged on the upper side of the plate 113a. The or each valve aperture 125c coordinated with a passage 113c is located, in plan view, within the connecting sector 113d which encloses the relevant passage 113c. The element 125 has, for each connecting sector 113d, connecting means 125d which are associated with the membrane 125a and have pegs passing through the anchoring holes of the plate 113a and annular retaining sections which fill the two retaining grooves of the plate and overlap one another, i.e. are coherent, and together form an 8-shape. The two connecting sectors 113d, their retaining grooves and the annular retaining sections of the connecting means 125d, which retaining sections fit into said grooves, could, however, also be a distance apart. The membrane 125a is connected by its connecting means 125d in the two annular connecting sectors 113d to the plate 113a in a manner analogous to that in which the membrane 25a is connected to the plate 13a. The plate 113a and the membrane 125a together form two inlet valves 127. The element 125 furthermore has a pair of ribs 125k which are coordinated with the membrane 125a and run upward away from the latter and which together define a groove which runs along the partition 105h and coincides with the latter in the plan view.

A pump element 131 has an element 133 having a resilient membrane 133a and an essentially dimensionally stable disk 135. The membrane 133a has an outlet and/or valve aperture 133c, which for example is located in its center and is connected to the case 105 and to the disk 135 in a manner similar to that in which the membrane 33a is connected to the case 5 and to the disk 35. The disk 135 is coordinated with a rib 135k which projects downward into the groove present between the ribs 125k and, together with the rib 125k, forms separating means which divide the space present between the membrane 125a and the pump element 131 in two pump chambers 139 of equal size. The disk 135 has, in the region of each pump chamber, at least one passage 135c consisting of a through hole. Those areas of the membrane 133a and of the disk 135 which are provided with the aperture 133c and the passages 135c together form an outlet valve 137. Furthermore, a cover 141 which can be unscrewed from the case 105 is also present.

The two inlet valves 127 can open and close independently of one another and, in the open state, each connect one of the stores 121 to one of the pump chambers 139. The outlet valve 137 common to both pump chambers 139 connects, in the open state, the two pump chambers 139 to the common outlet and/or valve aperture 135c. Otherwise, i.e. unless stated otherwise above, the dispenser 101 is similar to this dispenser 1.

When providing and filling the dispenser 101, one store 121 and the pump chamber 139 connected to the latter via one of the inlet valves 127 can be filled with a component 151 of a pasty product to be formed. The other store and the other pump chamber can be filled with another component 153 of a pasty product to be formed. The two components 151, 153 in turn both consist of a free-flowing, pasty product and can, for example, contain the same carrier and/or base substance and, at least in part, different active ingredients. If a person presses the pump element 131, the two separately stored components 151, 153 are pumped separately to the outlet valve 137 before being combined in the outlet and/or valve aperture 133c forming the outlet of said valve and also the outlet of the entire dispenser, and mixed with one another more or less uniformly. If the person using the dispenser scrapes off the product with at least one finger from the upper side of the membrane 133a and, for example, applies it to the skin on the face or on another part of the body, the components of the product are likewise further mixed with one another.

The separate storage of two components of a product is particularly advantageous when the two products contain active ingredients and/or auxiliaries which can react with one another under the action of air and its constituents—in particular oxygen and/or possibly water vapor—or in the absence of air and/or which have a greater tendency to react with air constituents in the mixed state than separately. Separate storage can therefore make it possible to store products which cannot be stored or can be stored only with the addition of large amounts of preservatives and the like.

When the movable part of the pump element 131 is pressed down, the rib 135k of the disk 135 slides temporarily deeper into the groove between the two ribs 125k of the membrane 125a fastened to the plate 113a. When pressing down the pump element 131 manually, the person using the dispenser 1 should of course not close the outlet and/or valve aperture 133c, which in this embodiment of the dispenser is, for example, in the center of the membrane 133a, but should preferably press on the membrane 133a close to the outlet and/or valve aperture 133c and thus in the inner or middle region of the membrane 133a. The disk 135 remains, at least under this condition, at least approximately parallel to the position assumed by the disk in the rest state and to the flat surface parts of the plate 113a and the membrane 125a connected to said plate. On pumping, the two components 151, 153 are then always conveyed at least approximately and practically exactly in the same, intended ratio and then mixed with one another. This ratio is also at least substantially independent of the content of the two stores.

The dispenser 201 shown in FIGS. 8, 9, 10 and 11 has a container 203 with an integral, generally cylindrical case 205. This has a base 205a and a sidewall 205b, which is provided at its upper end with an external thread 205c, and a cylindrical internal surface 205d and, in the region of mid-height, a through aperture 205g. It should be noted here that two or more holes 205g distributed at the same height along the circumference may also be present.

Figure 10:
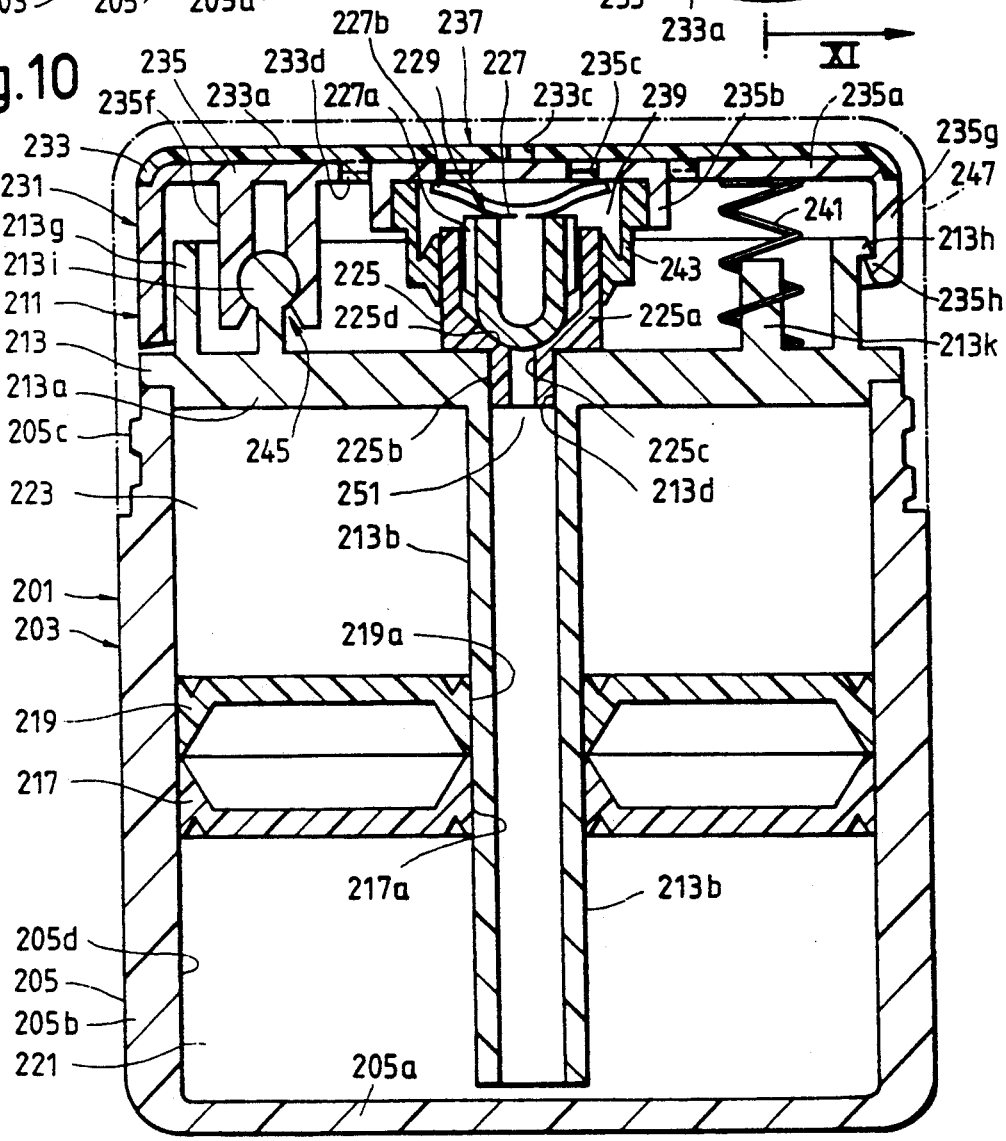
FIG. 10 shows a section along the line X—X of FIG. 9, on a larger scale.

The pump apparatus 211 located at the upper end of the case has a support 213 with a plate-like support part 213a, which is also referred to below as plate 213a for short. As in the case of the dispenser variants described above, this forms both a wall part of the pump apparatus 211 and of the entire container 3 and in fact an intermediate ceiling of the latter. A first nozzle 213b and a second nozzle 213c project from the plate 213a, parallel to the axis of the case, as far as a point close to the base 205a. The two nozzles 213c are, for example, arranged symmetrically with respect to the axis of the container 203. The support 213 has, at each nozzle 213b, 213c, an aperture 213d which has a section passing through the plate 213a and a section formed by the interior of the relevant nozzle. The first nozzle 213b has a compact, aperture-free sidewall and is open as far as its lower end, so that the aperture 213d present at the first nozzle enters the interior of the container 203 at the lower nozzle end. The second nozzle 213c has, at its end coordinated with the plate 213a, at least one radial aperture 213e penetrating its sidewall and in fact a plurality of such apertures which are distributed over its circumference. A rod-like insert 215 inserted into the second nozzle 213c closes the aperture 213d of the second nozzle 213c between its lower end and the apertures 213e. The plate 213a is coordinated, close to its edge, with a collar 213g which projects upward, i.e. away from the base 205a. This collar is generally cylindrical but has, at its circumferential point which in FIG. 10 is located to the right of a plane passing through the axis of the two apertures 213d, an outward-projecting stop 213h. On the other side of the plane passing through the axes of the two apertures 213d, a hinge part 213i consisting, together with the plate 13a, of an integral element is present inside the collar 213g and close to the latter. This hinge part is formed by a straight rib which is parallel to the stated plane, projects away from the plate 213a and has, at its end facing away from the plate, a thicker section which has a cylindrical cross-section and performs a function of a hinge pin. Close to the circumferential section of the collar 213g, which section has the stop 213h, and inside this collar, the plate 213a is coordinated with a peg 213k projecting away from it.

Two pistons 217 and 219 which are arranged one on top of the other in the interior of the container 205, have the same contours in plan view and each have two apertures 217a and 219a through which the nozzles 213b, 213c pass, and whose displacement is guided by the sidewall 205b and the two nozzles. In their starting position shown in FIGS. 10 and 11, the two pistons 217, 219 are, at certain points, adjacent to one another so that a cavity entered by the hole 205g is present between them. In the container 3, a first store 221 is present, between the base 205a and the piston 217 closer to this base, and a second store 223 is present between the plate 213a and the piston 219 located closer to this plate. The two stores have at least approximately and preferably exactly the same volumes or—more precisely—internal volumes.

At each aperture 213d, the support 213 is provided with a sleeve 225 which is rigidly connected to the plate 213a and has a main section 225a, resting on that side of the plate 213a which faces away from the base 205a and projecting away from this plate, and a thinner neck which fits tightly into the coordinated aperture 213d and, at its lower end, is flush with the underneath of the plate 213a. Each of the two sleeves 225 has a through, stepped aperture 225c. This has a narrower cylindrical section in the region of the neck 225b and a wider cylindrical section at its end opposite the neck, and a conical extension, which serves as valve seat 225d, between the two cylindrical sections.

Figure 12:
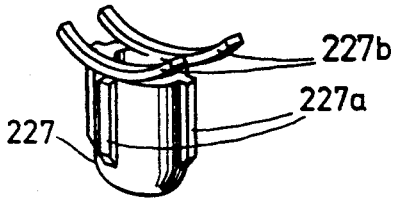
FIG. 12 shows a separate oblique view of one of the closure elements of the dispenser shown in FIGS. 8 to 11.

For each sleeve 225, a closure element 227 which for the most part is arranged in this sleeve and can be moved along its axis and hence along the axis of the aperture 213d in the relevant sleeve is present. One of these is shown separately in FIG. 12. Each closure element 227 has, as a main section, a U-shaped, hollow peg which is rotationally symmetric with respect to the axis, is closed at the lower end formed by the U-bend and is open at the other, upper end. Its cylindrical sidewall is provided on its outside with at least three and, for example, four guide ribs 227a distributed over its circumference. Furthermore, four elastically deformable, tongue-like springs 227b, which together in pairs form an arc and, at their upward-projecting, free ends, are supported on the pump element 231 described in more detail are molded on the upper end of the U-shaped main section. The springs 227b together form spring means which press the U-shaped main section of each closure element 227 under spring force against the coordinated valve seat 225d. Each sleeve 225 together with the closure element 227 forms an inlet valve 229 of the pump apparatus 211.

Figure 9:
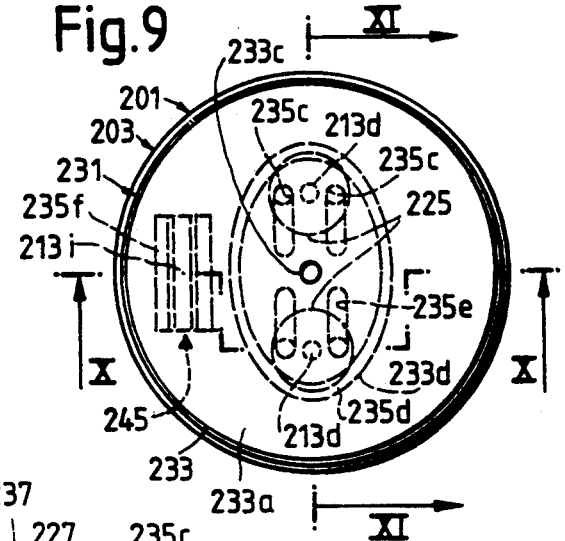
FIG. 9 shows a plan view of the pump element of the dispenser shown in FIG. 8.

The pump element 231 belonging to the pump apparatus 211 and arranged on that side of the plate 213a which faces away from the base 205a has an integral, soft, elastomeric element 233 and a generally dimensionally stable, integral element 235. The element 233 has a membrane 233a with a main part which is flat in the undeformed rest state and is penetrated by an outlet and/or valve aperture 233c which in plan view is located, for example, between the two inlet valves 229 in the center of the membrane 233a. The element 233 also has connecting means 233d which are coordinated with membrane 233a and, for example similar to the connecting means 33d, have a few pegs distributed along a coherent line and have an annular retaining section which is connected by means of these to the membrane and in plan view preferably encloses the two apertures 213d present in the plate 213a and—as shown in FIG. 9—is, for example, elliptical or oval. The edge of the membrane 233a is bent, for example, toward the base 205a.

The integral element 235 has a generally flat disk 235a. Two annular collars 235b, each of which is coaxial with one of the valve apertures 213d, project from said disk toward the disk 213a, the two collars, for example, being coordinated in plan view and together forming an 8. In each of the areas of the disk 235 which are enclosed by one of the collars 235b, this disk is provided with at least one passage 235c which penetrates the disk, i.e. with two such passages. The membrane 233a is connected tightly to the disk 235a by the connecting means 233d in a connecting sector 235d enclosing the outlet and/or valve aperture 233c and all passages 235c. In the connecting sector, the disk 235a has, for each peg of the connecting means 233d, an aperture through which the peg passes and an elliptical or oval retaining groove which receives the annular retaining section of the connecting means 233d. Each passage 235c consists of a circular aperture, i.e. a hole and a groove 235e which is present in the disk 235a on that side of the disk 235a facing away from the plate 213a and extends to a point close to the outlet and/or valve aperture 233c but is still a distance away from the aperture and forms that mouth of the passage 235c which faces the membrane 233a. Those sections of the membrane 233a or the disk 235a which have the outlet and/or valve aperture 233c and the passages 235c together form the outlet valve 237 of the pump apparatus 211.

The element 235 also has a hinge part 235f with two webs which project away from the disk 235a toward the plate 213a, are parallel to one another, are slightly springy and have, close to their free ends, channels which face one another and into which the cylindrical thicker part of the hinge part 213i is snapped. The hinge parts 213i, 235f together form a hinge 245 which rotatably connects the pump element 231 to the support 213. The axis of rotation of the hinge is parallel to the plate 213a and to the plane which passes through the two apertures 213d.

The element 235 furthermore has an annular flange 235g which is coordinated with the edge of the disk 235a, projects away from the disk toward the plate 213a and grips the collar 213g on the outside. Its lower edge is inclined away from the plate 213a, from its circumferential region close to the hinge part 235f to a circumferential region the farthest away from the hinge part 235f, as shown particularly clearly in FIG. 8. The flange 235g has, at the stop 213h, an inward-projecting stop 235h which grips underneath stop 213h in the position of the pump element 231 shown in FIGS. 8, 10 and 11. The pump apparatus 211 has at least one spring 241 in contact with the support 213 and with the pump element 231, i.e. a coiled compression spring is pushed over the peg 213k and, together with the springs 227b, pushes the pump element 231 away from the plate 213a.

An integral ring 243 is present for each sleeve 225 and has a lower end section which at least to some extent totally encloses the main section 225a of the relevant sleeve 225 and is displaceable along its axis, and an upper, slightly wider edge section which fits firmly in the collar 235b. The web connecting the two edge sections of the ring 241 to one another is slightly deformable so that it can convert horizontal swings of the element 235 and of the ring edge section fastened to it into displacements of the ring edge section enclosing the relevant sleeve 225. Each of the two sleeves 225, together with the part of the disk 235a present inside a collar 235b and the coordinated ring 243, define a pump chamber 239, i.e. a first pump chamber on the right in FIG. 11 and a second pump chamber on the left in FIG. 11. The two sleeves 225 and the two rings 243 each have the same dimensions so that the internal areas measured in plan view and the internal volumes of the two pump chambers 239 are of the same magnitude. The aperture 213d of the first continuously open nozzle 213d and the aperture 225c of the sleeve 225 coordinated with the first nozzle together form a first passage 251 which connects the first store 221 to the first pump chamber 229 through the support part 213a. The open section of the aperture 213d and the apertures 213e of the second nozzle 213c, together with the aperture 225c of the sleeve 225 coordinated with the second nozzle, form a second passage 253 which connects the second store 223 to the second pump chamber 239.

Figure 8:
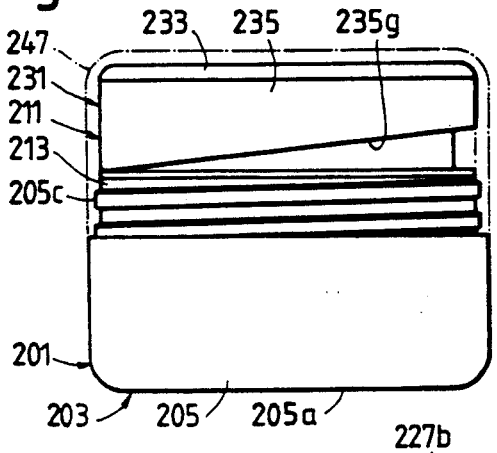
FIG. 8 shows a side view of a dispenser having a rotatable pump element and two stores, the cover of the dispenser merely being indicated by dash-dot lines.
Figure 11:
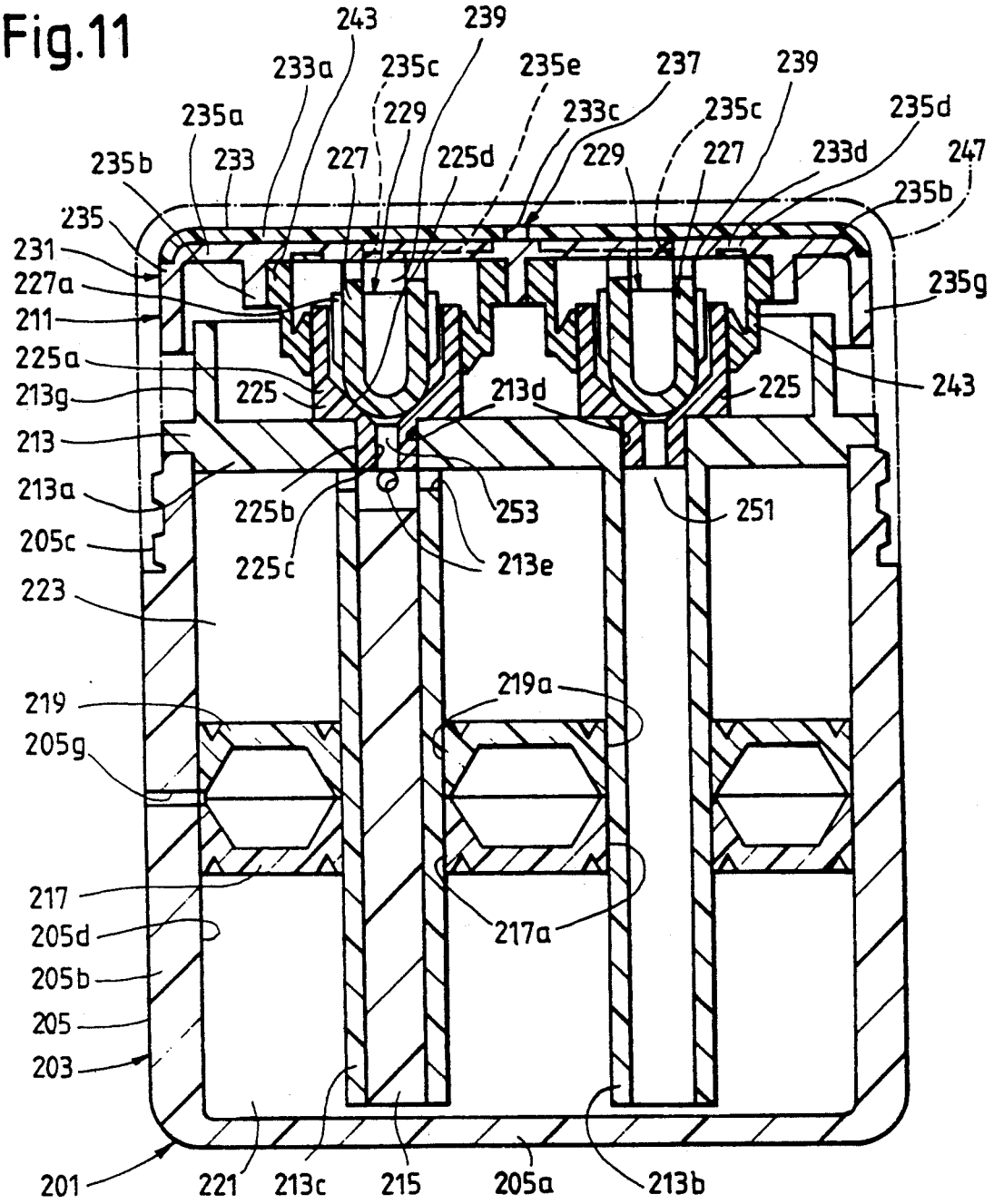
FIG. 11 shows a section along the line XI—XI of FIG. 9, on the same scale as FIG. 10.

The dispenser also has a cover 247 which is indicated by a dash-dot line in FIGS. 8, 10 and 11 and has an internal thread which is detachably screwed with the external thread 205c. The various described parts of the dispenser 201 consist—with the possible exception of the spring 241—of injection moldable plastics, as in the case of the dispensers described above. The spring 241 may consist of a metallic material or, like the other parts of the dispenser, of plastic.

In assembling the dispenser 201, its stores 221, 223 are each filled with a component of the product to be dispensed, which is not shown, in such a way that the two pistons 217, 219 are in their starting positions shown in FIGS. 10, 11, so that the aperture 205g which serves for venting enters the cavity present between the pistons. Filling of the product components is effected in such a way that they also fill the passages 251, 253 of the two inlet valves 229, the pump chambers 239 and the passages 235c passing through the disk 235a.

If the pump apparatus 211 is in the rest state shown in FIGS. 8, 10 and 11, the disk 235a is parallel to the plate 213a and—when the dispenser stands upright horizontal like the plate. Furthermore, the two inlet valves 229 and the outlet valve 237 are closed. If, on removing cover 247, a person swivels the pump element 231 manually, in opposition to the force generated by the spring 241, against the plate 213a of the support 213, the outlet valve 237 opens in a manner similar to that in the dispensers 1, 101, so that certain amounts of the components of the pasty product which are present in the two pump chambers 239 are pumped out through the outlet valve 237 and thus mixed with one another. If the person using the dispenser releases the pump element, the latter swivels back to the rest position via the springs 227b, 241. Pasty product components are sucked out of the two stores 221, 223 through the inlet valves 229 and into the pump chambers 239. Sucking out of the product components from the two stores 221, 223, in conjunction with the air present between the two pistons 217, 219, results in the lower piston 217 being pushed downward and the upper piston 219 being pushed upward, further air flowing from the environment through the aperture 205g into the cavity between the two pistons.

Since the pump element 231 is rotatably connected to the support 213 by the hinge 245, the volumes of the two pump chambers 229 are always both changed in exactly the same ratio whenever the pump element is temporarily manually pressed down, regardless of the pressure point where a person presses on the pump element. Accordingly, the ratio of the amounts of the two product components pumped out each time the pump element is operated is always exactly 1:1.

Unless stated otherwise above, the dispenser 201 has similar properties to the dispenser 1 and in particular 101.

Figure 13:
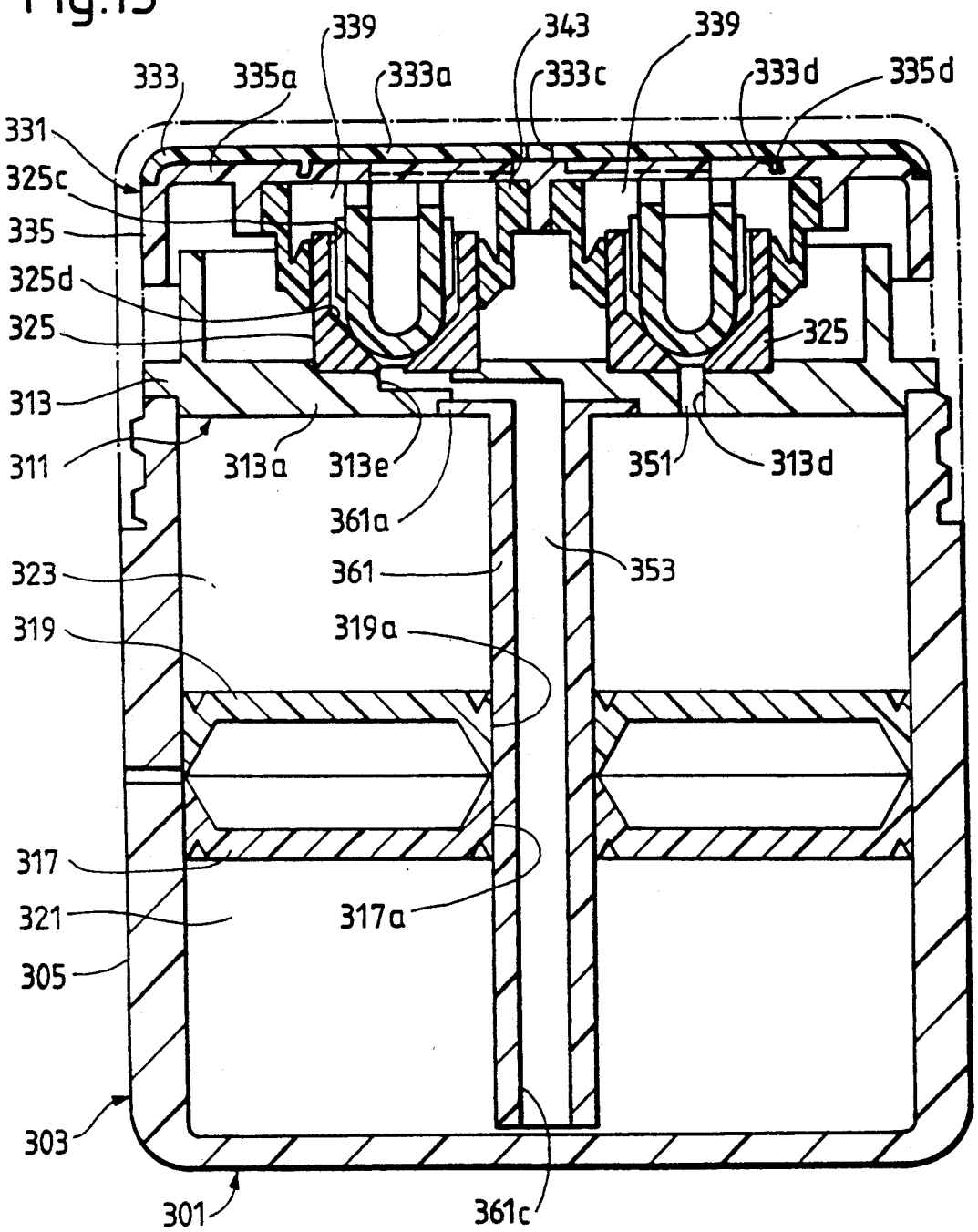
FIG. 13 shows a section, corresponding to FIG. 11, through a dispenser having two stores, which for a major part is similar to the dispensers shown in FIGS. 8 to 11.

The dispenser 301 shown in FIG. 13 is partially fairly similar to the dispenser 201 according to FIGS. 8 to 11 and has a container 303 with a case 305 on the upper end of which a pump apparatus 311 is arranged. This in turn has a support 313 with a plate-like support part 313a which is fastened to the case edge and is provided with two apertures 313d, 313e which pass through it. The aperture 313d consists of a straight hole arranged off-center. The aperture 313e passes through the support part 313a in a Z-shape and has, on the lower side of the support part 313a, a mouth coaxial with the axis of the container 303 and, on the upper side of the support part 313a, an eccentric mouth. A hollow cylindrical nozzle 361 coaxial with the container axis has, at the upper end, an outward-projecting collar 361*a* which fits, and is fastened, in the lower mouth of aperture 313*e*, and a through axial aperture 361*c*. In the container 303, a first, lower piston 317 and a second, upper piston 319, each having an aperture 317*a* or 319*a*, respectively, which is coaxial with the container axis and is penetrated by the nozzle 361 are displaceable and are guided. In the container 301, a first store 321 is present between its base and the first piston 317 and a second store 323 is present between support 313 and the second piston 319. A sleeve 325 is inserted and fastened in each of the upper mouths of the apertures 313*d*, 313*e*. The sleeves 325 are formed similarly to the sleeves 225 described above and have in particular a through aperture 325*c* with a section serving as valve seat 325*d*. Furthermore, the two sleeves 325 are arranged, for example, symmetrically with respect to the axis of the container 303.

A pump element 331 has a one-piece element 333 which essentially consists of an elastically deformable membrane 333*a* having an outlet and/or valve aperture 333*c*. The element 333 also has connecting means 333*d*. These consist, for example, of retaining sections which together form a rim, i.e. a ring divided by slots, project away from the membrane 333*a* toward the support part 313*a* and enclose the major part of the aperture 333*c*. The disk 335 belonging to the pump element has, in its connecting sector 335*d*, an annular retaining groove with an undercut. The retaining sections coordinated with the membrane 333*a* are snapped in the retaining groove and anchored and in particular also grip behind its undercut. The two sleeves 325 and the disk 335, together with rings 343 corresponding to the rings 243, define two pump chambers 339. The first store 321 is connected to the first pump chamber 339 on the right in FIG. 13 by a first passage 351 formed by the aperture 313*d* and the aperture 325*c* of the sleeve 325 present therein. The apertures 361*c*, the aperture 313*e* and the aperture 325*c* of the sleeve 325 present in the latter together form a second passage 353, which connects a second store 321 to the second pump chamber 339 on the left of FIG. 13.

Unless stated otherwise above, the dispenser 301 shown in FIG. 13 can be of a form similar to that of the dispenser 201 described with reference to FIGS. 8 to 11.

Figure 14:
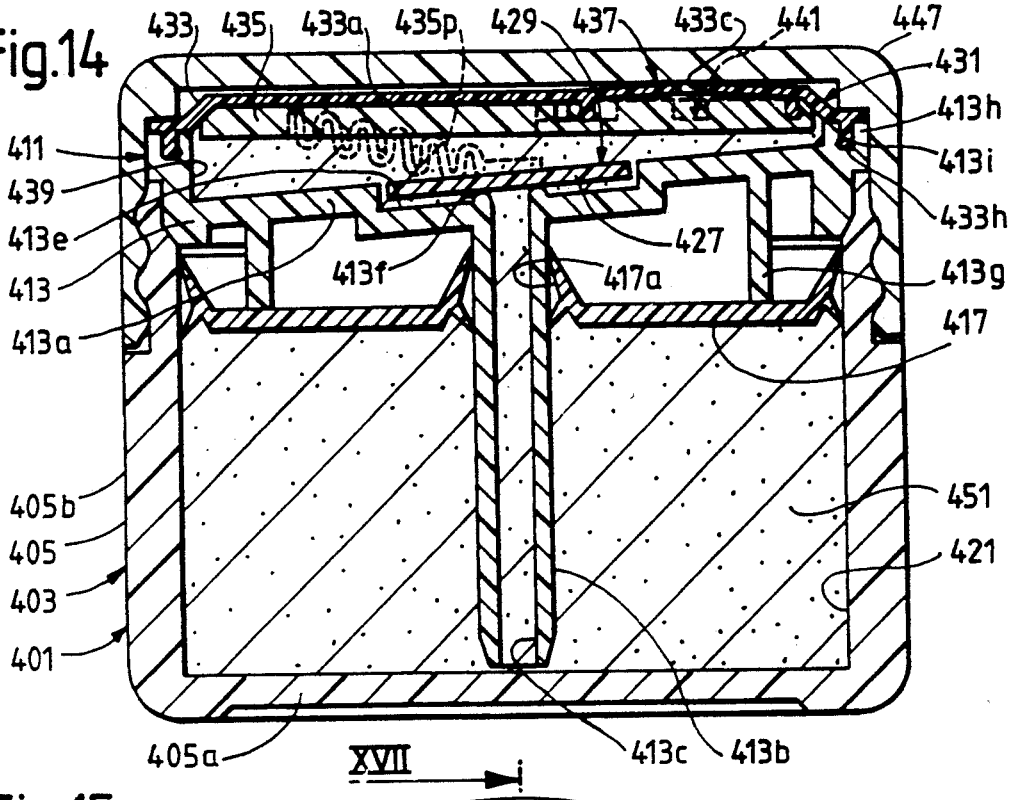
FIG. 14 shows an axial section through another dispenser having only a single store.
Figure 15:
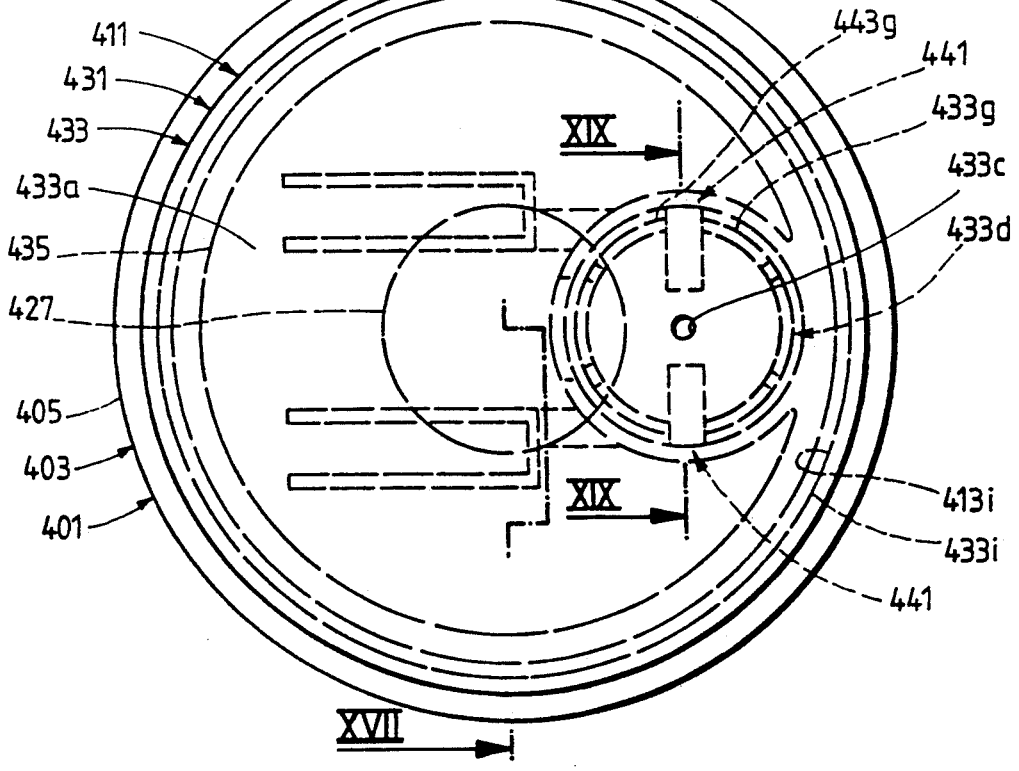
FIG. 15 shows a plan view of the pump element of the dispenser drawn in FIG. 14, with the cover removed.

The dispenser 401 shown in FIGS. 14 and 15 has a container 403 with a case 405 which has a base 405*a* and a generally cylindrical sidewall 405*b*.

Figure 18:
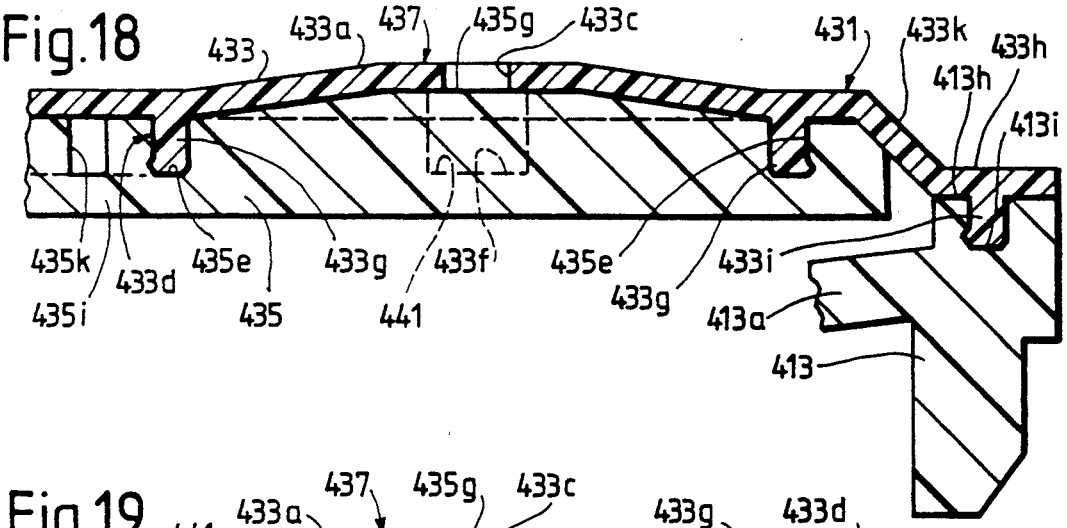
FIG. 18 shows a section from FIG. 14 with part of the pump apparatus of the dispenser according to FIGS. 14, 15, on an enlarged scale.

A pump apparatus 411 has a one-piece support 413 with a generally plate-like support part 413*a*. The support rests with its edge on the upper edge surface of the sidewall 405*f* of the case 405 and with a downward-projecting ring on an inner surface section of the sidewall 405*b* and is tightly fastened thereto, i.e. welded. In contrast to the plate-like support part or plates of the dispenser embodiments described above, the plate-like support part 413*a* is not horizontal but inclined slightly—for example not more than 10°—with respect to a horizontal plane and thus makes a non-90° angle with the axis of the container. The plate-like support part 413*a* is coordinated with a nozzle 413*b* which projects away from it to a point close to the base 405*a* and is coaxial to the axis of the container 403. The support 413 is provided with a passage 413*c* which extends from the lower end of the nozzle 413*b* to the upper side of the support part 413*a* and thus passes through the latter. The support part 413*a* has, in the central region, a section which is displaced downward, so that its otherwise flat upper side or surface has an indentation 413*e* there. However, an annular projection or collar which projects upward above the bottom of said indentation, encloses the upper mouth of the passage 413*c* and forms a valve seat 413*f* is present in said indentation. The support 413 furthermore has an annular attachment which projects downward from the support part 413*a*, has a horizontal edge at its lower end and serves as stop 413*g* for a piston 417. The support 413 also has, at the edge of the plate-like support part 413*a*, an upward-projecting, annular attachment 413*h* with an annular retaining groove 314*i* open at the top. This has, close to its bottom, a small undercut which is particularly clearly shown in FIG. 18.

The above-mentioned piston 417 which is displaceable between the base 405*a* and the plate-like support part 413*a* in the container 403 has, in the center, an aperture 417*a* penetrated by the nozzle 413*b* and forms the upper limit of a store 421 present in the container. A closure element 427 which consists of a flat disk and, together with the valve seat 413*f* and springs described, forms the inlet valve 429 is displaceably held in the indentation 413*e*.

Figure 16:
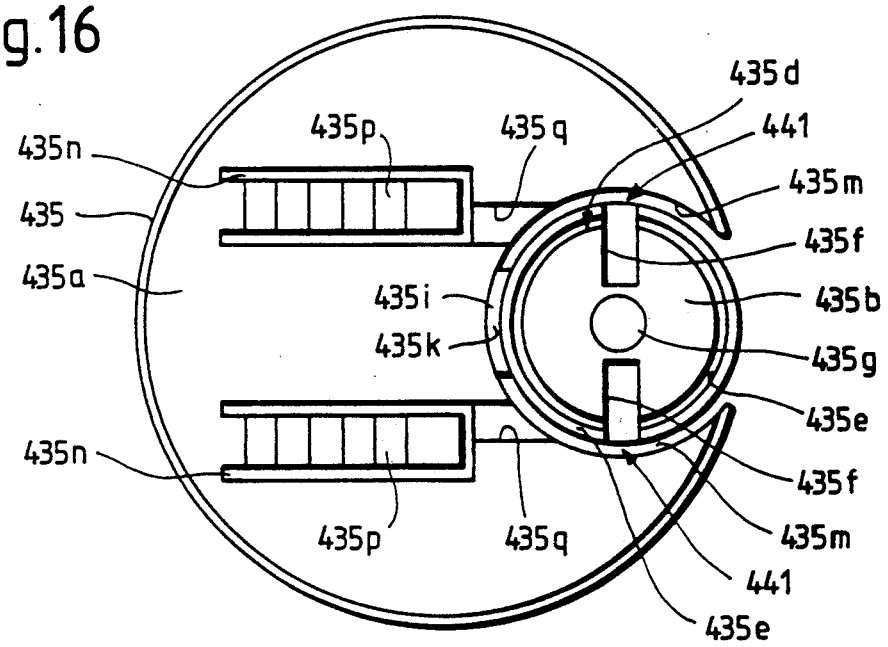
FIG. 16 shows a plan view of the disk of the pump element of the dispenser shown in FIGS. 14, 15, with the membrane removed.
Figure 17:
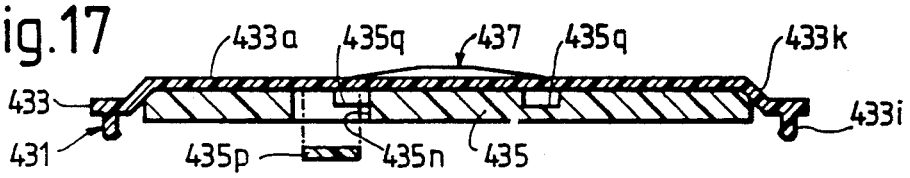
FIG. 17 shows a section through the pump element of the dispenser according to FIGS. 14, 15, along the line XVII—XVII in FIG. 15.
Figure 19:
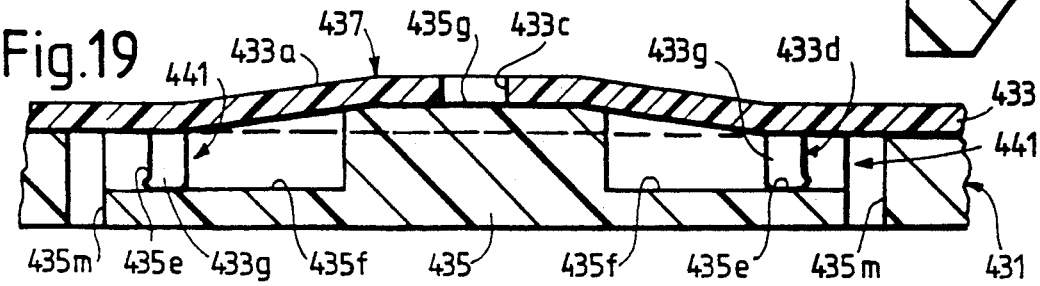
FIG. 19 shows a section through part of the pump element of the dispenser according to FIGS. 14, 15, along the line XIX—XIX in FIG. 15, on the same scale as FIG. 18.

The pump apparatus 411 in turn includes a pump element 431 with a one-piece, relatively soft, resilient element 433 and a one-piece, at least generally dimensionally stable disk 435 arranged underneath this. The element 433 is also shown completely or partly in FIGS. 17, 18 and 19. The disk 435 is shown separately in FIG. 16 and also completely or partly in FIGS. 17 to 19. The element 433 is formed by a membrane 433*a* with an eccentric outlet and/or inlet valve aperture 433*c* and connecting means 433*d* which for the major part enclose said aperture. These means are formed by a plurality of springy retaining sections 433*g*, for example four to ten thereof, each of which consists of a rib which projects downward away from the membrane 433*a* and is arc-shaped in plan view. The retaining sections 433*g* together form, in plan view, a circular ring divided by slots. The edge section 433*h* of the membrane 433*a* rests on the edge surface of the annular support attachment 413*h*, said surface being radial with respect to the container axis, and has a downward projecting retaining section 433*i* consisting of an annular rib, or a plurality of arc-shaped retaining sections 433*i* which together form a ring. The or each retaining section 433*i* is elastically deformable and is snapped into the retaining groove 413*i* and grips behind its undercut. The edge section 433*h* of the membrane 433*a* is thus firmly and tightly connected to the support 413. The membrane has a central main section, which for the most part is flat and horizontal when the pump element is in the rest state, and a narrow, annular deformation area 433*k* which connects said main section to the edge section 433*h* fastened to the support 413 and which, in the rest state, is inclined conically downward and outward.

The disk 435 is generally circular. The diameter of the disk 435 is at least 80% and, for example, at least 90% of the internal diameter of the attachment 413*h*. As shown particularly clearly in FIG. 16, the disk 435 has a main section 435*a* and a smaller outlet section 435*b* which is arranged eccentrically with respect to its center and to the container axis and has a circular contour. The center of the outlet section 435*b* is located below the outlet and/or valve aperture 433*c* of the membrane 433*a*. The outlet section 435*b* is connected firmly to the membrane 433*a* by the connecting means 433*d* in a connecting sector 435*d* which for the major part encloses the aperture 433c in plan view. In the connecting sector, the disk 435 has, on its side which faces away from the membrane 433a, an annular retaining groove 435 which has an undercut between its orifice ending in the surface of the disk and its base. The retaining groove 435g is divided at two circumferential points into two arc-shaped parts by a groove 433h present on the upper side of the outlet section 435f and running radially with respect to the aperture 433c. The grooves 435e, 435f have, for example, the same depths. Each elastically deformable retaining section 433g coordinated with the membrane 433a is snapped into the retaining groove 435e in such a way that it projects into the latter and grips behind its undercut. The retaining sections 433g are distributed along the retaining groove 435e in such a way that free spaces are present between the retaining sections 433g in the area of the grooves 435f crossing said retaining groove.

The disk 435 is completely flat on its lower side facing the support part 413a and is horizontal in the rest state shown in FIGS. 14, 17, 18 and 19. On its upper side, the disk is likewise generally flat but has, in the area located below the outlet and/or valve aperture 433c, a small protuberance 435g, which is particularly clearly shown in FIGS. 18 and 19. The protuberance 435g is, for example, in the form of a truncated cone and limited in the central area by a flat surface which is horizontal when the pump element is in the rest state and whose edge is joined by a surface which inclines slightly conically downward and extends as far as the inner edges of the arc-shaped retaining grooves 435e. The disk 435 is furthermore provided, at its edge on the upper side, with a conical bevel, against which the conical deformation area 433k of the membrane 433 rests in the rest state.

The pump element 431 is arranged, with respect to support 413, in such a way that the outlet section 435b of the disk 435 is located above the uppermost region of the inclined, plate-shaped support 413a. The outlet section 433b is connected, in its circumferential area located closest to the center of the disk 435, to the main section 435a by a web 435i which is arc-shaped in plan view. The web is limited on its upper side by the base of an arc-shaped groove 435k. That contour or edge region of the outlet section 435b which faces away from the web 435i partly borders the surrounding of the disk 435 and thus forms part of its edge. The remaining parts of the contour or edge of the outlet aperture 435b are formed by two slots 435m which have incisions from the disk edge and are arc-shaped in plan view. The web 435i extends, in a plan view of that side of the disk 435 which faces towards the membrane, over a central angle around the center of the aperture 433c which is not more than 90° and, for example, not more than or about 60°. The outlet section accordingly has a free edge which is not coordinated with the main section 435a and which extends along a central angle of at least 270°. The web 435i is more or less flexible than the disk sections connected by it and adjacent to it and thus forms a sort of flexible joint.

Otherwise, it should also be mentioned that the web 435i may be replaced by two or more narrower webs separated from one another by slots. These webs should then all be arranged in that half of the circumference of the outlet section which is closest to the center of the disk and together should preferably extend over a central angle of not more than 90°.

The main section 435a of the disk 435 is also provided with two elongated slots 435n. These each contain, in plan view, an elongated, wavy spring 435p which is coordinated at one end with the remainder of the disk 435. The springs 435b together with the disk must consist of a one-piece element. In plan view, the springs are slightly narrower than the slots 435n, so that a U-shaped gap which, in plan view, partly encloses the spring present in it is left in each slot 435n. The flat end sections of the springs, which sections are not coordinated with the disk, are located below the remainder of the disk 435 and engage the closure element 427 of the inlet valve 429. The springs 435p press, on the one hand, the closure element 427 against the valve seat 413f and, on the other hand, the disk 435 or—more precisely—that disk part which does not form the springs upward and away from the support part 413a. Each U-shaped slot 435n is connected to the arc-shaped slot 435m close to it by a groove 435q present on the upper side.

The disk 435 is—as mentioned above—generally dimensionally stable. The disk is more rigid than the membrane 433a, in particular—with the possible exception of the web 435i and the springs 435p —and thus for the major part of its surface facing the membrane 435a.

That section of the membrane 433a which is provided with the outlet and/or valve aperture 433c and with the connecting means 433d forms, together with the outlet section 435b of the disk 435, the outlet valve 437. A pump chamber 439, into which the closable passage 413c of the inlet valve 429 enters, is present between the plate-like support part 413a and the pump element 431. Each slot 435m present in the disk 435 forms, together with the groove 435f connected to it, a passage 441 which connects the pump chamber 439 to that surface area of the disk 435 which faces the membrane 433a and is enclosed for the major part—i.e. apart from the groove 435f—by the connecting sector 435d. The grooves 435f form the mouths of the passages 441 which enter into the last-mentioned disk surface area. Furthermore, the slots 435n together with the grooves 435q form branches of the two passages 441 and thus also belong to these.

The dispenser 401 also has a cover 447 which is detachably screwed onto the case 405 and shown only in FIG. 14.

After the production of the various parts of the dispenser 401, pasty product 451 to be dispensed is filled into the case 405, which is still separated from the pump apparatus. Thereafter, the pump apparatus 411 assembled beforehand—i.e. the support 413 together with the piston 417 held on the nozzle 413b and the pump element 431 connected to the support—is pushed onto or into the case. The support 413 is then welded and/or adhesively bonded to the case 405. The amount of pasty product 451 filled into the case beforehand is such that, when the pump apparatus is mounted, the product fills the store 421 and the passage 413c, flows through the inlet valve 429 into the pump chamber 439 and also fills the latter, the passages 441, the slots 435n and the grooves 435q. The air present in the pump chamber beforehand can flow out through the slots 435m, 435n, grooves 435q, 435f and the outlet and/or valve aperture 433c.

If a person, when using the dispenser 401, presses manually, i.e. with at least one finger, on the pump element 431, the latter can—if sufficient pressure is exerted—be moved, for example, downward to such an extent that it rests with the lower side or surface of the disk 435 on the plate-like support part 413*a*. The disk 435 is both pushed downward and swivelled, that section of the deformation area 433*k* of the membrane which is on the right in FIGS. 14 and 18 serving more or less as a flexible joint.

In the rest state of the pump element 431, as shown in FIGS. 14, 17, 18 and 19, the membrane 433*a* on the upper side of the disk 435 rests against the entire flat surface of the latter and also against the bevel present at the disk edge. The main section of the membrane 433*a*, which section is enclosed by the deformation area 433*k*, is flat when the membrane is relaxed and separate from the disk. However, the protuberance 435*g* presses that section of the membrane 433*a* which is in its vicinity in an upward direction so that the resilient membrane is stretched there and rests against the protuberance 435*g* with a certain tension in an area bordering the edge of the outlet and/or valve aperture 433*c* and completely enclosing the aperture, and thus seals the outlet valve 437 thoroughly and tightly.

If a person presses the pump element in the manner described above against the plate-like support part 413*a*, the pasty product 451 present in the pump chamber can lift the membrane 433*a* from the disk in the region of the outlet section 435*b* of the disk 435, analogously to the stores described above, so that pasty product can flow outward from the grooves 435*f* to the outlet and/or valve aperture 433 and through the latter. On the other hand, that part of the membrane 435 which is located above the main section 435*a* of the disk 435 still rests against the disk at least for the major part, even when the pump element is pressed down.

The web 435*i* which connects the main section 435*a* and the outlet section 435*b* of the disk 435 and serves as a flexible joint help to ensure that the membrane and the disk are well adapted to one another when pressed down. Unless stated otherwise above, the dispenser 401 has similar properties to the dispenser 1.

Figure 20:
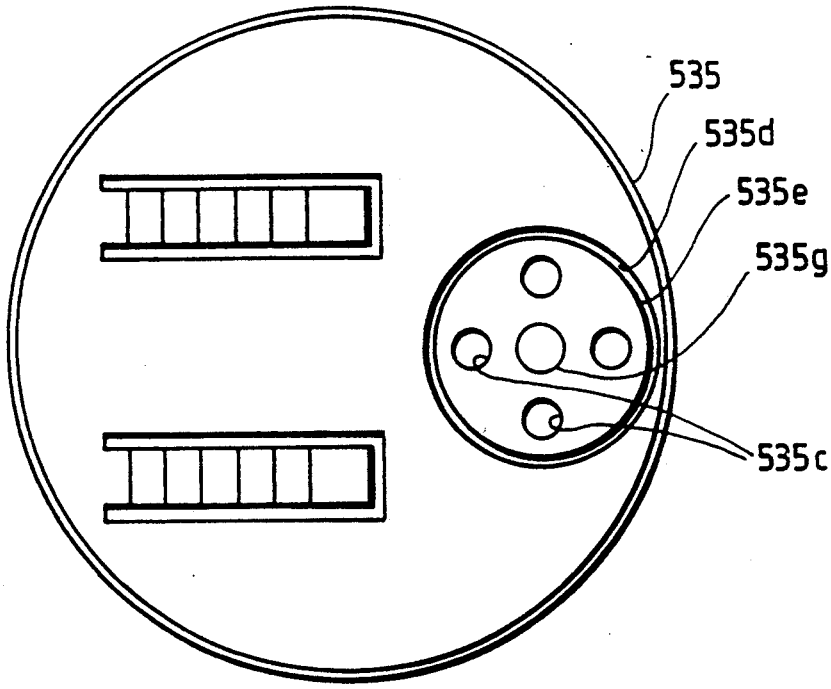
FIG. 20 shows a plan view, analogous to FIG. 16, of a variant of a disk of a pump element

The disk 435 of the dispenser 401 can be replaced by the disk 535 shown in FIG. 20. This differs from the disk 435 in that the slots 435*m* and the grooves 435*f*, 435*q* are absent and instead four passages 535*c*, each consisting of a circular aperture, i.e. a hole, are present and, in plan view, are distributed around the outlet and/or valve aperture of the membrane located above the disk 535 and not shown in FIG. 20. The passages 535*c* and in particular their mouths terminating in that surface of the disk 535 which faces the membrane are of course once again, in plan view, a distance away from the outlet and/or valve aperture of the membrane or—more precisely from the edges of this aperture. The passages 535*c* terminate, for example, in the conical surface of the protuberance 535*g* of the disk 535, which protuberance is in the form of a truncated cone. Otherwise, in the disk 535, the retaining groove which is present in the connecting sector 535*d* of the disk 535 consists of an annular groove which completely and continuously encloses the outlet and/or valve aperture of the membrane and the passages 535*d* and has an undercut. The connecting means of the membrane, which is not shown, have an annular retaining section or a few, for example about four to ten, retaining sections, each of which consists of an arc-shaped rib and is uniformly distributed along the annular retaining groove 535*c* and is anchored therein by being snapped in. Apart from the differences described above, the disk 535 can be identical or similar to the disk 435.

Figure 21:
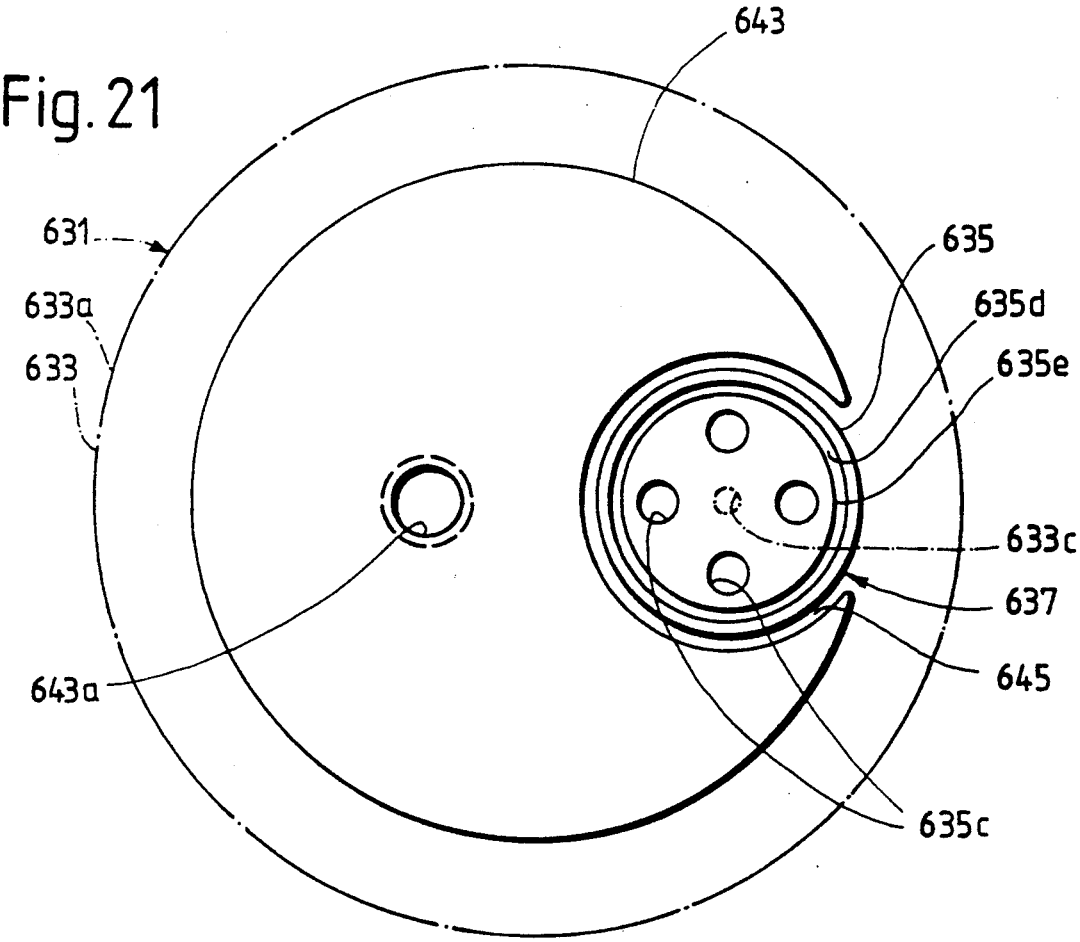
FIG. 21 shows a plan view of two disks belonging to a variant of a pump element, the border line and the outlet aperture and/or valve aperture of the membrane of the pump element being merely indicated by dash-dot lines.

The pump element 631 shown in FIG. 21 has a one-piece element 633 which is indicated only in part by a dash-dot line and is formed by a membrane 633*a* with an outlet and/or valve aperture 633*c*. The pump element 631 possesses two disks 635 and 643 arranged below the membrane. These disks 635 and 643 have similar contours and are arranged similarly to the outlet section 435*b* or the main section 635*a* of the disk 635, but the two disks 635, 643 are completely separated from one another by an arc-shaped slot 645. The disk 635 possesses passages 635*c* distributed around its center and around the outlet and/or valve aperture 533*c* of the membrane located above it, each passage consisting of a circular aperture, i.e. a hole, and is tightly connected to the membrane 635*a* by connecting means, in a connecting sector 635*d* completely enclosing the passages. The disk is provided in the connecting sector with, for example, an annular retaining groove 635*e* which has an undercut and in which a retaining section belonging to the element 633 and coordinated with the membrane 633*a* is snapped or anchored. The disk 635 together with the membrane 633*a* forms the outlet valve 637. The disk 643 has a retaining aperture 643*a* approximately in the middle between the disk 635, and its circumferential point opposite the latter. The retaining aperture consists, for example, of a hole which is provided at the lower end with an extension. The element 633 has connecting means connecting the membrane 633*a* to the disk 643, i.e. a retaining peg molded on the membrane 633*a* and snapped into the retaining aperture 643*a* and anchored therein.

The pump apparatus to which the pump element 631 belongs also has a support which is formed, for example, similarly to the support 413 and which, for example together with a closure element formed similarly to the closure element 427, forms an inlet valve. The pump apparatus may furthermore have a leaf spring consisting of a separate element, or another spring, which acts on the disk 643 and/or possibly on the disk 635 and on the stated closure element and corresponds functionally to the spring 435*p*. Unless stated otherwise above, the pump apparatus and the dispenser to which the pump element 631 belongs may have a form and properties similar to the form and properties of the pump apparatus 411 or the dispenser 401.

As mentioned above in the introduction, a dispenser according to the invention can also be used for dispensing a liquid product. In this case, during dispensing the dispenser can be arranged, for example, in such a way that the pump element is located on the lower side of the dispenser. If a dispenser is used, for example, for dispensing liquid soap, it can be fastened with the pump element underneath, above a wash basin.

The embodiment of the dispenser can also be altered in other ways within the scope of the invention. For example, features of the dispensers 1, 101, 201, 301 and 401 of the disk 535 and of the pump element 631 can be combined with one another in a number of ways. For example, at least one spring, which, for example, acts on the dimensionally stable disk of the pump element and presses the latter away from the support part opposite it, can be provided in the case of the dispensers 1 and 101, similarly to the dispensers 201, 401, in or adjacent to the or each pump chamber. In addition to the restoring force generated by the resilience of its membrane, a restoring force is also then exerted by the or each spring on the pump element. This can be advantageous in particular if the product to be pumped has a very high viscosity.

Furthermore, the outlet and/or valve aperture 33c of the dispenser 1 can be arranged highly eccentrically or in the center of its membrane 33a. Moreover, the outlet and/or valve aperture 133c, 233c, 333c of the dispenser 101 or 201 or 301, respectively, can be arranged eccentrically with respect to the case 105 or 205 or 305, respectively, and the membrane 133a or 233a or 333a, respectively, but the outlet and/or valve aperture in such modifications of the dispenser 101, 201 or 301 should advantageously be approximately in the middle between the two pump chambers 139 or 239 or 339.

The dispenser 101, 201 or 301 may furthermore be modified in such a way that the two product components are dispensed and mixed with one another not in a ratio of 1:1 but in another ratio. For this purpose, the two pump chambers are made different sizes, so that the ratio of their volumes or—more precisely internal volumes and the ratio of their internal surface areas, measured in plan view, are equal to the ratio in which the components are to be dispensed. The volume ratio of the two stores is then also made approximately or exactly equal to the desired ratio of the components to be dispensed.

This can be effected, for example starting from the dispenser 101, if the diametral rib 135k and the diametral partition 105h are replaced by a rib or partition having two radial sections which make an angle with one another and are coordinated with the axis of the case, so that the cavity present between the plate 113a and the pump element 131 and the interior of the case in plan view are each divided into two circular sectors of different sizes. Instead, it is also possible to provide a rib or partition which is straight or off-center and thus forms, in plan view, a chord of the case sidewall which is shorter than the internal diameter of the case sidewall.

If a dispenser, like the dispenser 201, has stores and pistons arranged one above the other is to be provided for dispensing product components in a ratio other than 1:1, for example, the external diameter of the sleeve main sections 225a and the internal diameter of the rings 243 for the two pump chambers can be of different dimensions and the starting positions of the two pistons can be defined accordingly.

If stores and pistons are arranged side by side as in the dispenser 101, it is also possible, where necessary, to provide more than two separate stores and the same number of separate pump chambers and then store more than two product components separately and mix them with one another when they emerge from the dispenser.

Furthermore, the sidewalls of the cases and covers may have outer and/or inner surfaces which— apart from their threads which serve for screwing them together—are not cylindrical but have, for example, an elliptical, oval or polygonal cross-section.

In addition, the dispensers 1, 101 and 401 can be modified in such a way that the or each store is located between the pump apparatus and the piston or one of the pistons, so that the or each piston occupies its position furthest away from the pump apparatus when the store is full and moves toward the pump apparatus when the product is being pumped out. In this case, the wall of the container can be provided, close to its side opposite the pump apparatus, with a vent aperture through which air can flow into the container during movements of the or each piston. It may even be possible to dispense with a wall part corresponding to the case base 5a or 105a or 405a and merely to provide, at the relevant end of the container sidewall, means for preventing the pistons from falling out. The container would then be essentially open on its side opposite the pump apparatus, i.e. closed only by the piston or pistons. For this purpose, the support part corresponding to the plate-like support part or the plate 13a or 113a or 413a, together with the sidewall of the container, may consist of a one-piece element. Instead of the passages running through the nozzles 13b, 113b or 413b, only passages penetrating the plate-like support part may then be provided. Such an embodiment of the dispenser is advantageous in particular if the pump element is located on the lower side of the dispenser when the latter is in use, as is practical, for example, in the case of a dispenser for liquid soap.

In the dispenser 201, the nozzle 213c which improves the guidance of the piston but is not absolutely essential for discharging the product component stored in the store 223 can be omitted.

In the dispensers described above, the or each store consists of a storage chamber which is bordered by a dimensionally stable wall and a displaceable piston and is at least to some extent and preferably completely gas-tight with respect to the environment. The or each store can, however, also be at least partly and, for example, essentially completely bordered by a flexible sleeve and can be sealed gas-tight with respect to the environment and thus formed by the interior of a bag which is provided, for example, with a connection consisting of a hose piece or nozzle and is connected by means of this to a connection of the or an inlet valve. The bag can be arranged, for example, in a container having a dimensionally stable wall with at least one vent aperture, so that the surrounding air has access to the outer surface of the sleeve and the latter is compressed by the air pressure when the product is being pumped out of the store. The connections of the inlet valve and bag may furthermore be detachably connected to one another, and the container can be formed in such a way that the user of the dispenser can replace the empty bags with full bags.

The annular retaining sections of the connecting means of the membranes can also form polygonal or polygon-like, continuous or discontinuous rings in which the apices of the polygon are replaced with curved transitions. Furthermore, in the dispensers 1, 101, 201, instead of continuous annular retaining sections, a separate head-like retaining section projecting radially beyond the pegs at least in parts of the peg circumference can be provided for each peg of the fastening means. The embodiments of the parts connected by the connecting means to the membranes must then be correspondingly adapted.

In the inlet valves having a membrane and in the outlet valves, the number of passages which penetrate the plate-like support part or the disk can of course also be varied. For example, the disk 35 belonging to the outlet valve 37 can thus have more than two passages 35c or only one such passage. Furthermore, the membrane 33a, 133a, 233a, 333a, 433a 633a may even be provided with two or more outlet and/or valve apertures, which together then form the outlet of the relevant dispenser.

What is claimed is:

1. A pump apparatus for a free-flowing, in particular pasty or liquid, substance, comprising:

a support part;

a pump element which has an elastically deformable membrane and can be pressed against said support part in opposition to a restoring force; and a pump chamber, disposed between said pump element and the support part, fluidly connected to an inlet valve and to an outlet aperture by an outlet valve, wherein the outlet aperture passes through the membrane;

wherein, on a side of said membrane which faces the pump chamber, a disk is provided, the disk together with the membrane forming the outlet valve, the disk being connected to the membrane so that in a closed position the membrane rests against the disk in an area enclosing the outlet aperture, and so that in an open position the membrane is arched upward partly away from the disk by a pressure exerted on it by the free-flowing substance, thereby forming an open connection between the outlet aperture and the pump chamber, wherein the membrane is firmly connected to the disk in a connecting sector enclosing the outlet aperture of said membrane, at least around the major part of the circumference of the aperture of the membrane;

wherein the disk has at least one passage which passes therethrough and connects the pump chamber to a surface area of the disk, which surface area is at least partially enclosed by the connecting sector and faces the membrane; and wherein the aperture of said at least one passage which terminates at the surface area of the disk is located a distance away from the outlet aperture in a plan view of the membrane.

2. A pump apparatus as claimed in claim 1, wherein at least two passages which penetrate the disk are present, which passages terminate in positions distributed around the outlet aperture, at the surface area of the disk.

3. A pump apparatus as claimed in claim 1, wherein the at least one passage has an aperture which penetrates the disk and terminates at the surface area of the disk.

4. A pump apparatus as claimed in claim 1, wherein the at least one passage has a groove which is present in a side of the disk facing away from the membrane and which extends from the surface are partly enclosed by the connecting sector to a surface area located outside the connecting sector and is connected there, through the disk, to the pump chamber.

5. A pump apparatus as claimed in claim 1, wherein the disk has a main section and a smaller outlet section which is arranged eccentrically with respect to the center of the disk and is connected to the membrane and, by at least one web, to the main section and, in a plan view of a side facing the membrane, has a free edge which extends over a central angle of at least 270° around the center of the outlet aperture.

6. A pump apparatus as claimed in claim 1, wherein one of:

the disk, in a plan view, covers at least 50% of the area occupied by the pump chamber and, in addition to the disk which together with the membrane forms the outlet valve, another disk is fastened to the membrane, the two disks together covering at least 50% of the area occupied by the pump chamber, and wherein each disk connected to the membrane rests, at least with the major part of its surface facing the membrane, against the membrane, when said disk is in a position furthest away from said support part.

7. A pump apparatus as claimed in claim 1, wherein the disk is more rigid, at least in a region which rests against the outlet aperture around said outlet aperture when the membrane is in the closed position, than that region of the membrane which encloses the outlet aperture, and wherein the disk is more rigid, at least in the major part of its surface facing the membrane, than the membrane surface.

8. A pump apparatus as claimed in claim 1, wherein the membrane consists of a material whose modulus of elasticity is smaller than the modulus of elasticity of the material forming the disk connected to the membrane, the membrane and the disk consisting of an injection moldable thermoplastic.

9. A pump apparatus as claimed in claim 1, wherein the disk has through anchoring apertures distributed around the outlet aperture of the membrane, and wherein the membrane is coordinated with pegs which pass through the anchoring apertures and are coordinated, at their ends adjacent to the pump chamber, with at least one retaining section which rests against a side of the disk which faces the pump chamber.

10. A pump apparatus for a free-flowing, in particular pasty or liquid, substance, comprising:

a support part;

a pump element which has an elastically deformable membrane and can be pressed against said support part in opposition to a restoring force; and a pump chamber, disposed between said pump element and the support part, fluidly connected to an inlet valve and to an outlet aperture by an outlet valve, wherein the outlet aperture passes through the membrane;

wherein, on a side of said membrane which faces the pump chamber, a disk is provided, the disk together with the membrane forming the outlet valve, the disk being connected to the membrane so that in a closed position the membrane rests against the disk in an area enclosing the outlet aperture, and so that in an open position the membrane is arched upward partly away from the disk by a pressure exerted on it by the free-flowing substance, thereby forming an open connection between the outlet aperture and the pump chamber, wherein the disk has, on a side facing the membrane, at least one retaining groove which has an undercut between an orifice opposite the membrane and the disk base, and wherein the membrane has at least one retaining section including an integral element which, together with said membrane, projects the retaining groove and grips underneath the undercut.

11. A pump apparatus as claimed in claim 1, wherein the membrane has an edge section which encloses the outlet aperture and the disk, and is firmly and tightly connected to the support part.

12. A pump apparatus as claimed in claim 1, wherein the disk is rotatably connected to the support part by a hinge.

13. A pump apparatus as claimed in claim 1, further comprising at least one spring which acts on one of the disk and on an additional disk fastened to the membrane, and which forces this disk away from the support part.

14. A pump apparatus as claimed in claim 13, wherein a passage is provided which penetrates the support part, enters the pump chamber and forms a valve seat of the inlet valve, the inlet valve having a displaceably held closure element, wherein the at least one spring presses the closure element against the valve seat.

15. A pump apparatus as claimed in claim 1, wherein the support part has a passage which passes therethrough, wherein a further membrane is provided which, together with an associated passage, serves to form the inlet valve and is arranged on that side of the support part which faces the pump chamber, which further membrane has at least one valve aperture displaced laterally with respect to that mouth of the passage of the support part which faces said further membrane, at least two valve apertures being distributed around the mouth of the passage of the support part, and said further membrane is connected firmly and tightly to the support part in a connecting sector enclosing this mouth and these valve apertures.

16. A pump apparatus as claimed in claim 1, wherein at least two pump chambers separate from one another are present between the support part and the pump element, each of the two pump chambers being fluidly connected to an inlet valve, and wherein all pump chambers are fluidly connected to the same outlet aperture when the outlet valve is opened.

17. A pump apparatus as claimed in claim 16, wherein the support part is provided, for each inlet valve, with a passage penetrating therethrough and with a sleeve which borders a mouth terminating in the pump chamber, the sleeve projecting toward the disk and forming a valve seat, a closure element being displaceably arranged along an axis of the sleeve, and wherein the pump element has, for each inlet valve, a ring which is tightly connected to the disk, tightly enclosing the sleeve and forming part of the limit of the pump chamber.

18. A dispenser having a pump apparatus according to claim 2, wherein the pump chamber is connected by the inlet valve to at least one store.

19. A dispenser as claimed in claim 18, wherein a case is provided firmly connected to the support part, the case having a base and a sidewall and containing the at least one store, wherein the at least one store is partly defined by at least one piston which is displaceable in the case along the sidewall, and wherein the at least one store is disposed adjacent to the base and to the at least one piston and is connected to the inlet valve by a nozzle which penetrates the at least one piston and extends from the support part to a point close to the base.

20. A dispenser as claimed in claim 19, wherein two pistons and two stores are present in the case, wherein the two pistons are located one on top of the other between the base and the support part, and wherein one store is located between the support part and a piston nearer to said support part.

* * * * *